US011305528B2

(12) United States Patent
Ito

(10) Patent No.: US 11,305,528 B2
(45) Date of Patent: Apr. 19, 2022

(54) PRINTING DEVICE

(71) Applicant: FUNAI ELECTRIC CO., LTD., Osaka (JP)

(72) Inventor: Shingo Ito, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 6 days.

(21) Appl. No.: 17/090,898

(22) Filed: Nov. 6, 2020

(65) Prior Publication Data

US 2021/0187939 A1 Jun. 24, 2021

(30) Foreign Application Priority Data

Dec. 20, 2019 (JP) ..... JP2019-229904

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/045; B41J 2/04586; B41J 2/21; B41J 25/308
See application file for complete search history.

(56) References Cited

U.S. PATENT DOCUMENTS 9,141,104 B2 * 9/2015 Sohara ..... G05B 19/404

FOREIGN PATENT DOCUMENTS

JP 2003145877 5/2003

* cited by examiner

*Primary Examiner* — Thinh H Nguyen
(74) *Attorney, Agent, or Firm* — JCIPRNET

(57) ABSTRACT

Provided is a printing device that includes a Y-axis encoder outputting a pulse signal corresponding to a position of a head part in a predetermined direction, a Y-axis counter counting a count value based on the pulse signal from the Y-axis encoder, a control part that performs a first and a second controls, and a determination part determining that the Y-axis encoder is normal when a count value equal to or greater than a predetermined number is counted and determines that the Y-axis encoder is abnormal when a count value less than the predetermined number is counted in the first control. The control part shifts from the first control to the second control when the Y-axis encoder is determined to be normal, and the control part does not shift from the first control to the second control when the Y-axis encoder is determined to be abnormal.

11 Claims, 19 Drawing Sheets

PRINTING DEVICE

CROSS REFERENCE TO RELATED APPLICATIONS

This application claims the priority benefit of Japanese Patent Application No. 2019-229904, filed on Dec. 20, 2019. The entirety of the above-mentioned patent application is hereby incorporated by reference herein and made a part of this specification.

BACKGROUND

Technical Field

The disclosure relates to a printing device for performing printing on a recording medium.

Related Art

A printing device for performing printing on a recording medium by an inkjet method has been known (for example, see patent literature 1: Japanese Patent Application Laid-open No. 2003-145877). This type of printing device includes a head part that ejects ink toward the recording medium, a driving mechanism that causes the head part to move with respect to the recording medium in a main scanning direction and in a sub-scanning direction substantially orthogonal to the main scanning direction, an encoder that outputs an encoder signal corresponding to the position of the head part in the main scanning direction and the sub-scanning direction, and a control part that performs feedback control which drives the driving mechanism based on the encoder signal from the encoder.

The printing device described above further includes an abnormality detection part that detects whether the encoder signal is normally output from the encoder during printing operation.

In the printing device described above, for example, when the encoder signal is not normally output from the encoder due to a failure of the encoder, the control part may further continue to drive the driving mechanism because there is no feedback of the encoder signal from the encoder. As a result, there is a problem that the driving of the driving mechanism by the control part may become uncontrollable before an abnormality is detected by the abnormality detection.

SUMMARY

The disclosure provides a printing device that can determine in advance whether or not there is an abnormality in an encoder before a second control performed by a control part.

According to one embodiment of the disclosure, a printing device for performing printing on a recording medium is provided and includes: a head part that ejects ink toward the recording medium; a driving source that causes the head part to move in a predetermined direction with respect to the recording medium; an encoder that outputs a pulse signal corresponding to the position of the head part in the predetermined direction; a counter that counts a count value based on the pulse signal from the encoder; a control part that performs a first control which drives the driving source by applying a voltage to the driving source for a first time, and performs a second control which controls the driving source by applying a voltage to the driving source for a second time longer than the first time based on the count value from the counter; and a determination part which determines that the encoder is normal when the counter counts to a count value equal to or greater than a predetermined number and determines that the encoder is abnormal when the counter counts to a count value less than the predetermined number in the first control. The control part shifts from the first control to the second control when the determination part determines that the encoder is normal, and the control part does not shift from the first control to the second control when the determination part determines that the encoder is abnormal.

DESCRIPTION OF THE EMBODIMENTS

Hereinafter, embodiments of the disclosure are described in detail with reference to the drawings. In addition, each of the embodiments described below shows a comprehensive or specific example. Numerical values, shapes, materials, constituent components, arrangement positions and connection forms of the constituent components and the like shown in the following embodiments are examples and are not intended to limit the disclosure. Further, among the constituent components in the following embodiments, constituent components not listed in independent claims are described as arbitrary constituent components.

Embodiment 1

1-1. Structure of Printing Device

Figure 1:
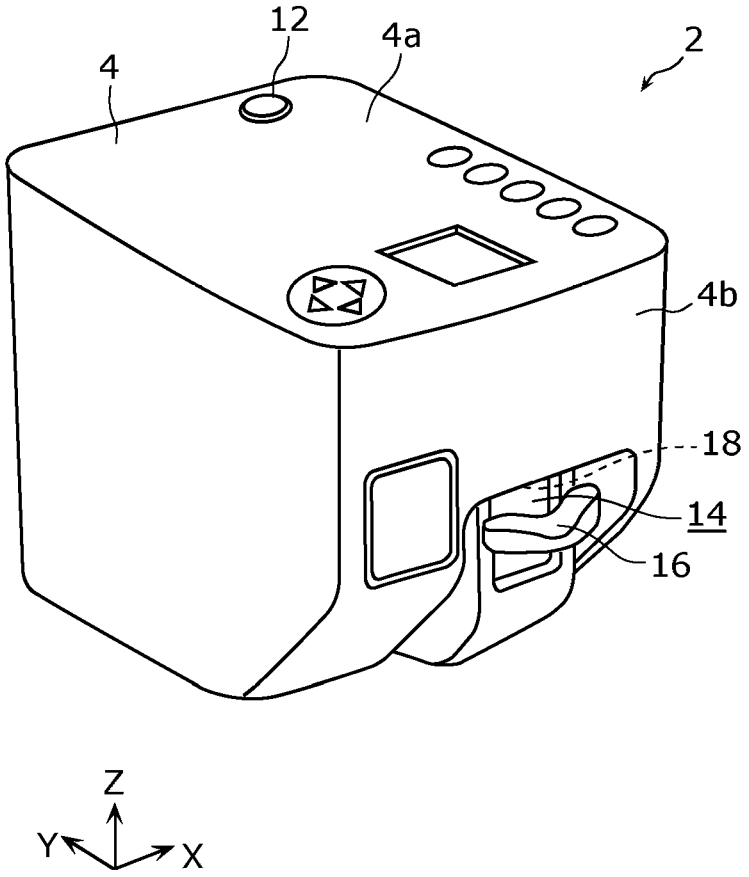
FIG. 1 is a perspective view showing an appearance of a printing device according to Embodiment 1.
Figure 2:
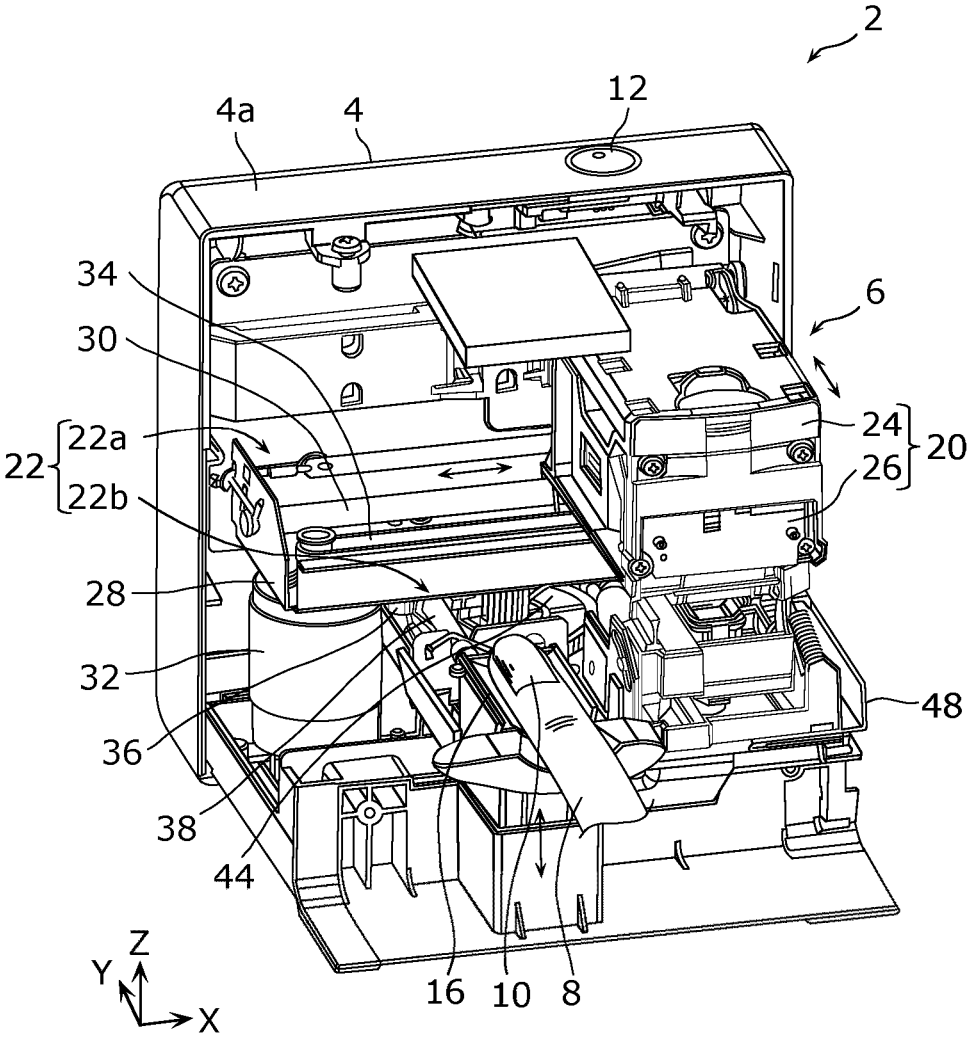
FIG. 2 is a perspective view showing a printing unit of the printing device according to Embodiment 1.
Figure 3:
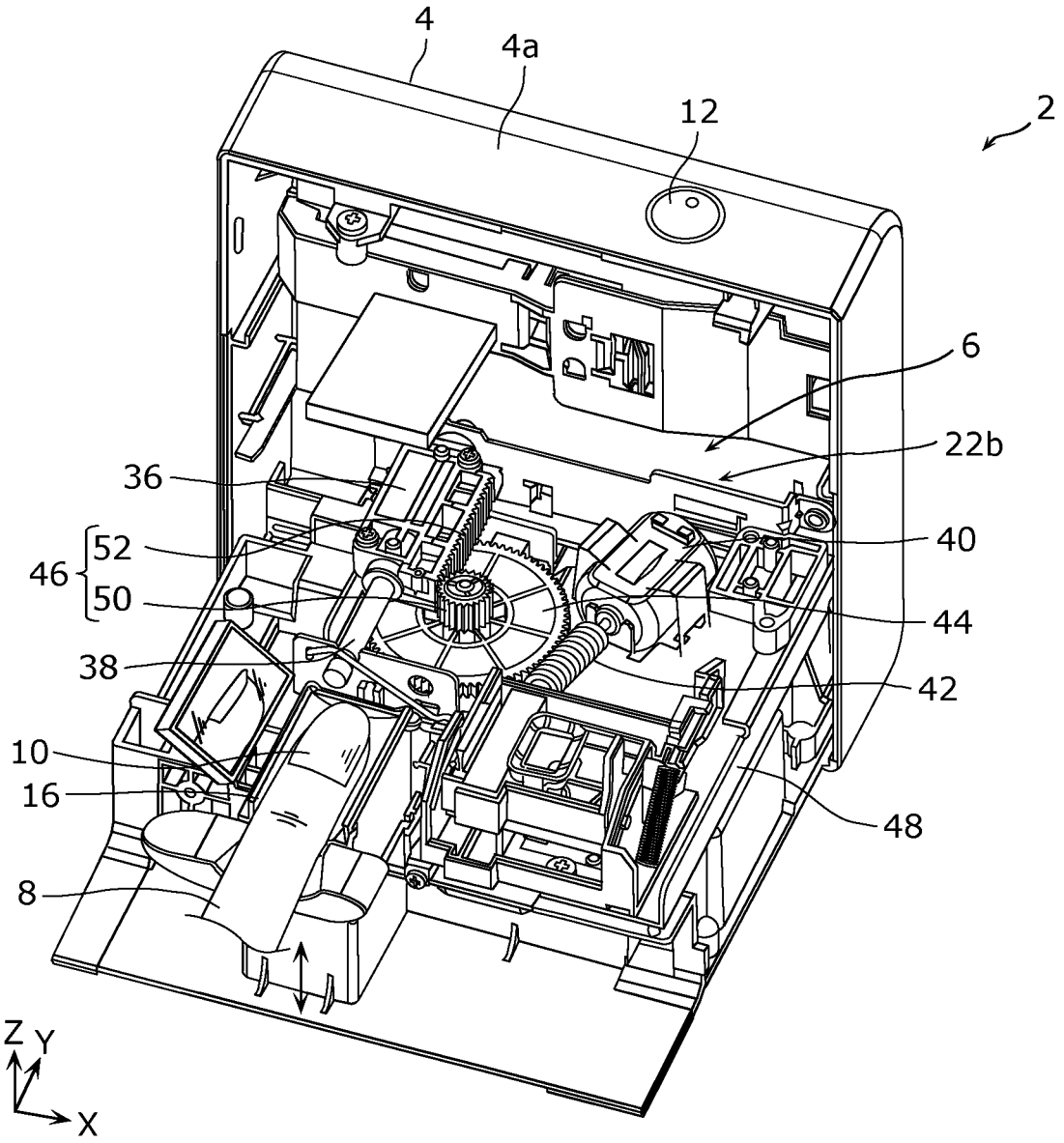
FIG. 3 is a perspective view showing the printing unit of the printing device according to Embodiment 1 with a head part and an X-axis driving mechanism omitted.

First, the structure of a printing device 2 according to Embodiment 1 is described with reference to FIG. 1 to FIG. 3. FIG. 1 is a perspective view showing an appearance of the printing device 2 according to Embodiment 1. FIG. 2 is a perspective view showing a printing unit 6 of the printing device 2 according to Embodiment 1. FIG. 3 is a perspective view showing the printing unit 6 of the printing device 2 according to Embodiment 1 with a head part 20 and an X-axis driving mechanism 22*a* omitted.

In addition, in FIG. 1 to FIG. 3, the width direction (left-right direction) of the printing device 2 is described as an X-axis direction, the depth direction (front-back direction) of the printing device 2 is described as a Y-axis direction, and the height direction of the printing device 2 is described as a Z-axis direction. Further, for convenience of description, in FIG. 2 and FIG. 3, a part of a housing 4 is cut away.

As shown in FIG. 1 to FIG. 3, the printing device 2 includes the housing 4 and the printing unit 6 arranged inside the housing 4. In the embodiment, the printing device 2 refers to a nail printer for performing printing for manicure use of color or pattern on a nail 10 of a finger 8 of a user's hand (an example of a recording medium).

In addition, the printing device 2 can wirelessly communicate with an external terminal (not shown) such as a smartphone or a tablet terminal. The user can operate the printing device 2 by using an application installed in the external terminal as an interface.

As shown in FIG. 1, the housing 4 is made of resin for example, and is formed into a box shape. A power switch 12 for turning on/off the power of the printing device 2 is arranged on a top surface 4*a* of the housing 4.

As shown in FIG. 1, an opening 14 for inserting the finger 8 of the user is formed on a front surface 4*b* of the housing 4. As shown in FIG. 1 to FIG. 3, a finger holder 16 for placing the finger 8 of the user is arranged on the lower side of the opening 14 (minus side of Z axis). Further, as shown in FIG. 1, a pressing cover 18 for pressing the finger 8 of the user from above is arranged on the upper side of the opening 14 (plus side of Z-axis). The finger holder 16 is movable in the vertical direction (Z-axis direction) with respect to the pressing cover 18, and is urged by a spring (not shown) in a direction approaching the pressing cover 18.

As shown in FIG. 2 and FIG. 3, the user inserts the finger 8 into the opening 14 (see FIG. 1) of the housing 4 while the finger 8 is extended straightly with the nail 10 of the finger 8 facing upward, and places the pulp side of the finger 8 on the finger holder 16. Thereby, a part of the finger 8 including the nail 10 (for example, a part of the finger 8 from tip to vicinity of the first joint) is arranged inside the housing 4. At this time, the finger holder 16 is urged in the direction approaching the pressing cover 18, and thereby for example the vicinity of the first joint of the finger 8 is clamped from above and below by the finger holder 16 and the pressing cover 18.

The printing unit 6 is a unit for performing printing for manicure use on the nail 10 of the finger 8 arranged inside the housing 4. The printing method of the printing unit 6 is an inkjet method in which mist-like ink is sprayed on the nail 10 of the finger 8 to thereby perform printing. As shown in FIG. 2, the printing unit 6 has a head part 20 and a driving mechanism 22.

The head part 20 has a carriage 24 and an ink tank 26 mounted on the carriage 24. The ink tank 26 is filled with four types of ink inside, for example, CMYK (C: cyan, M: magenta, Y: yellow, K: black). A nozzle surface (not shown) from which the ink supplied from the ink tank 26 is ejected downward toward the nail 10 of the finger 8 is formed on the lower surface of the carriage 24.

The driving mechanism 22 is a mechanism for causing the head part 20 to two-dimensionally move in a main scanning direction (X-axis direction) and a sub-scanning direction (Y-axis direction) substantially orthogonal to the main scanning direction (an example of a predetermined direction). As shown in FIG. 2 and FIG. 3, the driving mechanism 22 has an X-axis driving mechanism 22*a* for causing the head part 20 to move in the main scanning direction with respect to the nail 10 of the finger 8, and a Y-axis driving mechanism 22*b* for causing the head part 20 to move in the sub-scanning direction with respect to the nail 10 of the finger 8.

As shown in FIG. 2, the X-axis driving mechanism 22*a* has a moving table 28, an X-axis guide shaft 30, an X-axis motor 32, and a timing belt 34.

The X-axis guide shaft 30 is supported by the moving table 28 arranged inside the housing 4, and extends into an elongated shape in the X-axis direction. The head part 20 is movably supported on the X-axis guide shaft 30. The X-axis motor 32 is configured by, for example, a servo motor, and is supported by the lower surface of the moving table 28.

A driving force of the X-axis motor 32 is transmitted to the head part 20 via the timing belt 34. Thereby, the head part 20 moves in the X-axis direction along the X-axis guide shaft 30 with respect to the moving table 28.

As shown in FIG. 3, the Y-axis driving mechanism 22*b* has the moving table 28 (see FIG. 2), a bearing member 36, a Y-axis guide shaft 38, a Y-axis motor 40 (an example of a driving source), a worm gear 42, a worm wheel 44 and a driving conversion mechanism 46.

The Y-axis guide shaft 38 is supported by a base frame 48 arranged inside the housing 4, and extends into an elongated shape in the Y-axis direction. The bearing member 36 fixed to the lower surface of the moving table 28 is movably supported on the Y-axis guide shaft 38. That is, the moving table 28 is movably supported by the Y-axis guide shaft 38 via the bearing member 36. The Y-axis motor 40 is configured by, for example, a servo motor, and is supported by the base frame 48. The worm gear 42 is rotatably supported by a driving shaft of the Y-axis motor 40. The worm wheel 44 is rotatably supported by the base frame 48 and meshes with the worm gear 42.

The driving conversion mechanism 46 is a mechanism for converting rotation of the worm wheel 44 into linear movement of the head part 20 in the Y-axis direction. The driving conversion mechanism 46 has a pinion gear 50 formed on the worm wheel 44 and a rack gear 52 formed on the bearing member 36. The pinion gear 50 and the rack gear 52 mesh with each other.

A driving force of the Y-axis motor 40 is transmitted to the moving table 28 via the worm gear 42, the worm wheel 44, the pinion gear 50 and the rack gear 52. Thereby, the head part 20 moves integrally with the moving table 28 in the Y-axis direction along the Y-axis guide shaft 38.

While the head part 20 reciprocates in the main scanning direction and is moving from the other side toward one side (from plus side to minus side of Y-axis) in the sub-scanning direction, the ink is ejected from the nozzle surface of the head part 20 toward the nail 10 of the finger, and thereby the printing is performed on the nail 10 of the finger 8.

1-2. Function Configuration of Printing Device

Figure 4:
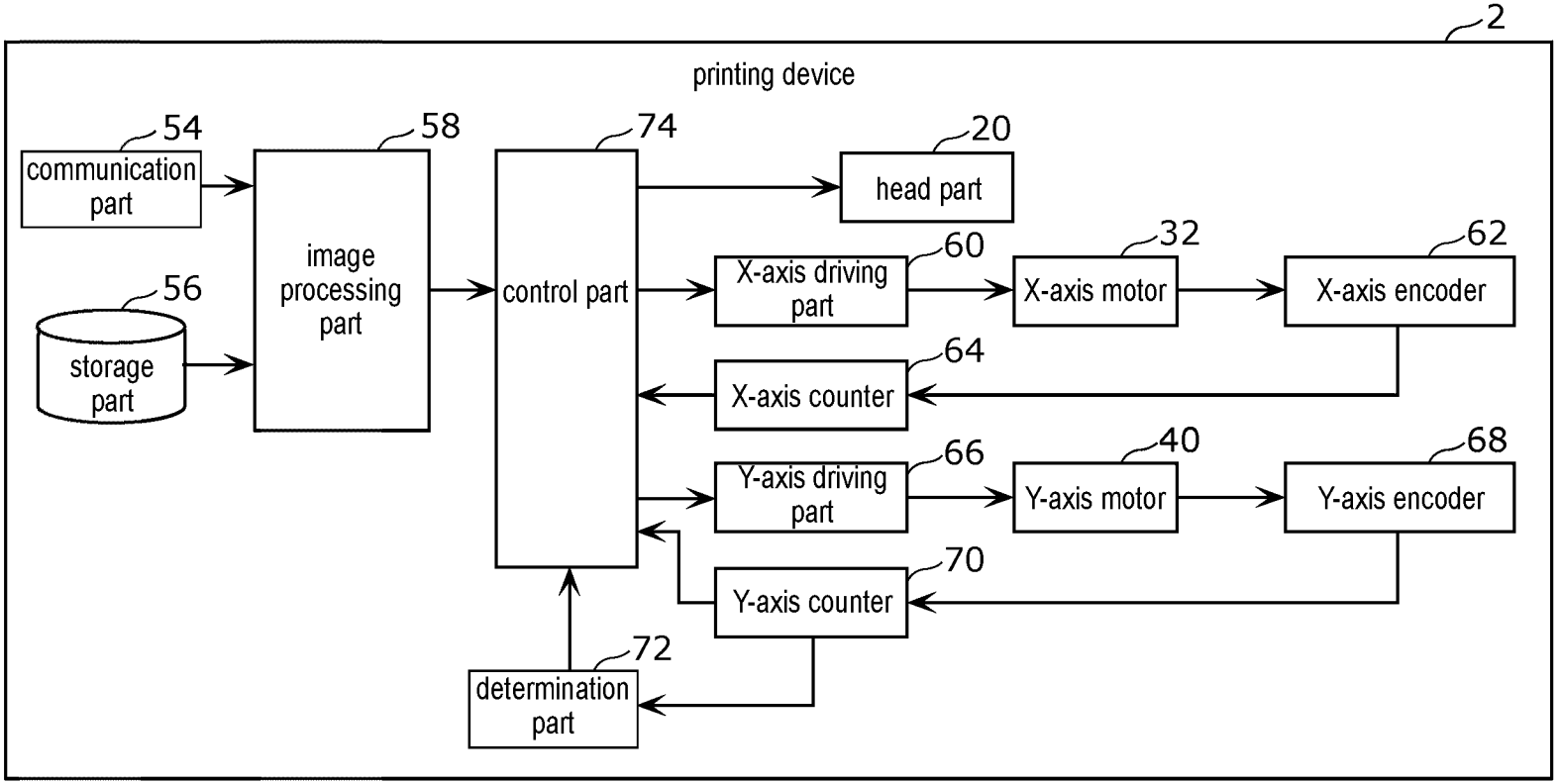
FIG. 4 is a block diagram showing the function configuration of the printing device according to Embodiment 1.

Next, the function configuration of the printing device 2 according to Embodiment 1 is described with reference to FIG. 4 to FIG. 5D. FIG. 4 is a block diagram showing the function configuration of the printing device 2 according to Embodiment 1. FIG. 5A to FIG. 5D are diagrams showing relationships between pulse signals from a Y-axis encoder 68 and count values counted by a Y-axis counter 70 according to Embodiment 1.

As shown in FIG. 4, the printing device 2 includes a communication part 54, a storage part 56, an image processing part 58, the head part 20, an X-axis driving part 60, the X-axis motor 32, an X-axis encoder 62, an X-axis counter 64, a Y-axis driving part 66, the Y-axis motor 40, the Y-axis encoder 68 (an example of an encoder), the Y-axis counter 70 (an example of a counter), a determination part 72, and a control part 74. In addition, because the head part 20, the X-axis motor 32 and the Y-axis motor 40 have been described, description thereof is omitted here.

The communication part 54 performs wireless communication with an external terminal (not shown) such as a smartphone or a tablet terminal. Specifically, the communication part 54 receives, for example, a print start signal for instructing the printing device 2 to start printing from the external terminal. The communication part 54 outputs the received print start signal and the like to the image processing part 58.

The storage part 56 is a memory for storing image data to be printed.

Based on the print start signal from the communication part 54, the image processing part 58 reads the image data stored in the storage part 56, and performs image processing on the read image data. The image processing part 58 outputs the image data that has undergone image processing to the control part 74.

The X-axis driving part 60 is a motor driver for driving the X-axis motor 32. That is, the X-axis driving part 60 causes the head part 20 to move in the main scanning direction with respect to the nail 10 of the finger 8 by applying a voltage to the X-axis motor 32.

The X-axis encoder 62 outputs an A-phase pulse signal and a B-phase pulse signal corresponding to the position of the head part 20 in the main scanning direction. The X-axis encoder 62 is, for example, a linear encoder arranged on the moving table 28. The A-phase pulse signal and the B-phase pulse signal have a phase difference of 90°. The X-axis encoder 62 outputs the A-phase pulse signal and the B-phase pulse signal to the X-axis counter 64.

The X-axis counter 64 counts a count value based on the A-phase pulse signal and the B-phase pulse signal from the X-axis encoder 62. The X-axis counter 64 outputs the counted count value to the control part 74.

The Y-axis driving part 66 is a motor driver for driving the Y-axis motor 40. That is, the Y-axis driving part 66 causes the head part 20 to move in the sub-scanning direction with respect to the nail 10 of the finger 8 by applying a voltage to the Y-axis motor 40.

The Y-axis encoder 68 outputs an A-phase pulse signal (an example of a first pulse signal) and a B-phase pulse signal (an example of a second pulse signal) corresponding to the position of the head part 20 in the sub-scanning direction. The Y-axis encoder 68 is, for example, a rotary encoder arranged on the worm wheel 44. The A-phase pulse signal and the B-phase pulse signal have a phase difference of 90° (an example of a predetermined phase difference). The Y-axis encoder 68 outputs the A-phase pulse signal and the B-phase pulse signal to the Y-axis counter 70.

The Y-axis counter 70 counts a count value based on the A-phase pulse signal and the B-phase pulse signal from the Y-axis encoder 68. In addition, when the head part 20 is moving forward in the sub-scanning direction (toward minus direction of Y-axis), the Y-axis counter 70 counts up the count value. Meanwhile, when the head part 20 is moving backward in the sub-scanning direction (toward plus direction of Y-axis), the Y-axis counter 70 counts down the count value. The Y-axis counter 70 outputs the counted count value to the determination part 72 and the control part 74.

Here, the count value counted by the Y-axis counter 70 is specifically described with reference to FIG. 5A to FIG. 5D.

Figure 5A:
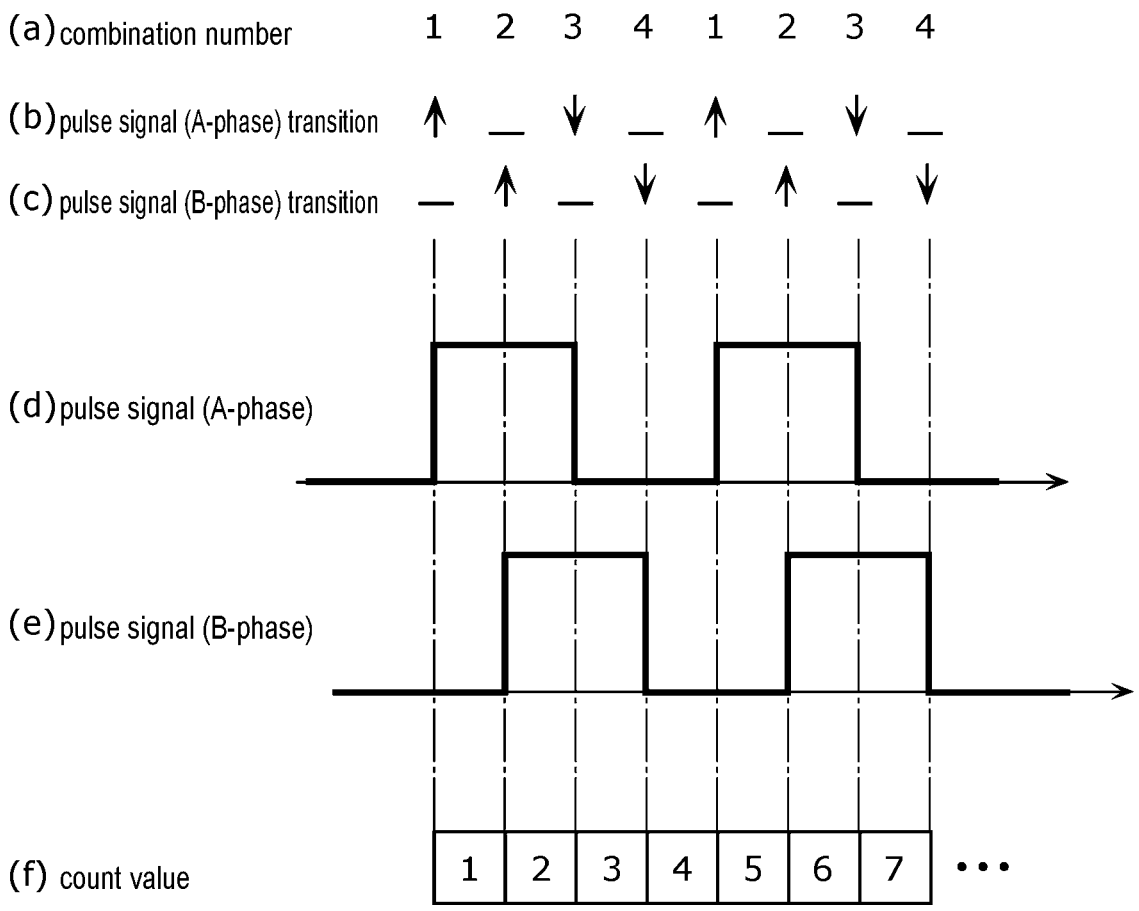
FIG. 5A is a diagram showing a relationship between pulse signals from a Y-axis encoder and count values counted by a Y-axis counter according to Embodiment 1.

When the Y-axis encoder 68 is normal and the head part 20 is moving forward in the sub-scanning direction, as shown in (d) and (e) of FIG. 5A, the Y-axis encoder 68 outputs an A-phase pulse signal and a B-phase pulse signal.

Here, as shown in (a) to (c) of FIG. 5A, as the combination of the transition of each waveform of the A-phase pulse signal and the B-phase pulse signal, there are four kinds of combinations: i) the A-phase pulse signal rises, and the B-phase pulse signal is constant (combination number=1); ii) the A-phase pulse signal is constant, and the B-phase pulse signal rises (combination number=2); iii) the A-phase pulse signal falls, and the B-phase pulse signal is constant (combination number=3); and iv) the A-phase pulse signal is constant, and the B-phase pulse signal falls (combination number=4).

In this case, as shown in (f) of FIG. 5A, the Y-axis counter 70 counts up the count value by "1" in a manner such as "1"→"2"→"3"→"4" . . . at each timing of the rise edge and the fall edge of the A-phase pulse signal and the rise edge and the fall edge of the B-phase pulse signal.

Figure 5B:
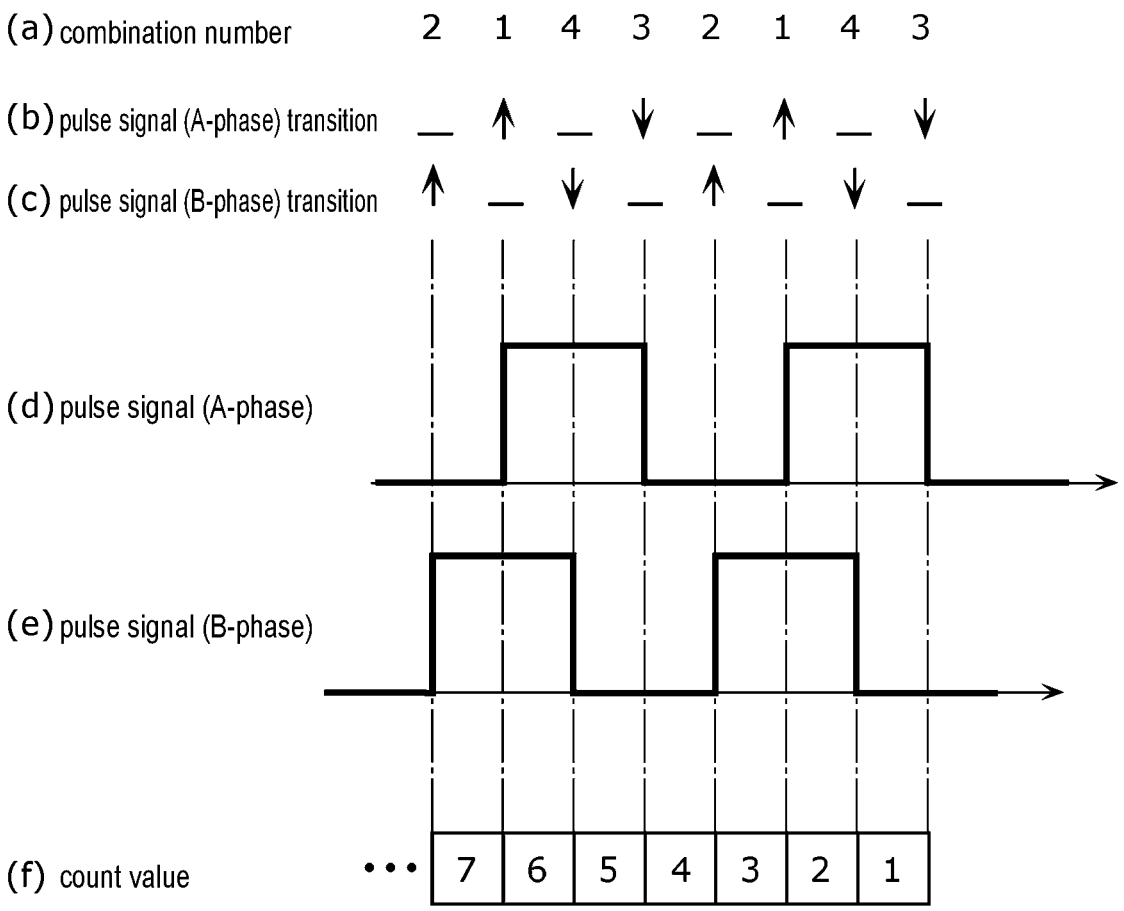
FIG. 5B is a diagram showing a relationship between pulse signals from the Y-axis encoder and count values counted by the Y-axis counter according to Embodiment 1.

Further, when the Y-axis encoder 68 is normal and the head part 20 is moving backward in the sub-scanning direction, as shown in (d) and (e) of FIG. 5B, the Y-axis encoder 68 outputs an A-phase pulse signal and a B-phase pulse signal.

Here, as shown in (a) to (c) of FIG. 5B, as the combination of the transition of each waveform of the A-phase pulse signal and the B-phase pulse signal, there are four kinds of combinations: i) the A-phase pulse signal is constant, and the B-phase pulse signal rises (combination number=2); ii) the A-phase pulse signal rises, and the B-phase pulse signal is constant (combination number=1); iii) the A-phase pulse signal is constant, and the B-phase pulse signal falls (combination number=4); and iv) the A-phase pulse signal falls, and the B-phase pulse signal is constant (combination number=3).

In this case, as shown in (f) of FIG. 5B, the Y-axis counter 70 counts down the count value by "1" in a manner such as "7"→"6"→"5"→"4" . . . at each timing of the rise edge and the fall edge of the A-phase pulse signal and the rise edge and the fall edge of the B-phase pulse signal.

Figure 5C:
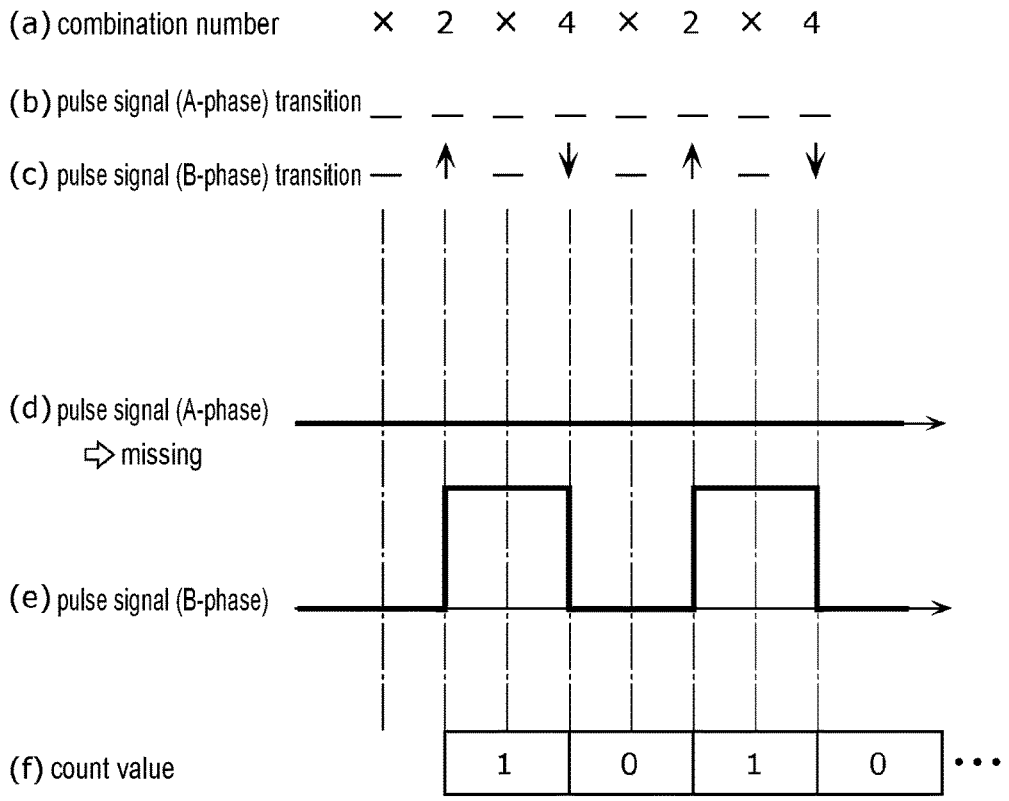
FIG. 5C is a diagram showing a relationship between pulse signals from the Y-axis encoder and count values counted by the Y-axis counter according to Embodiment 1.
Figure 5D:
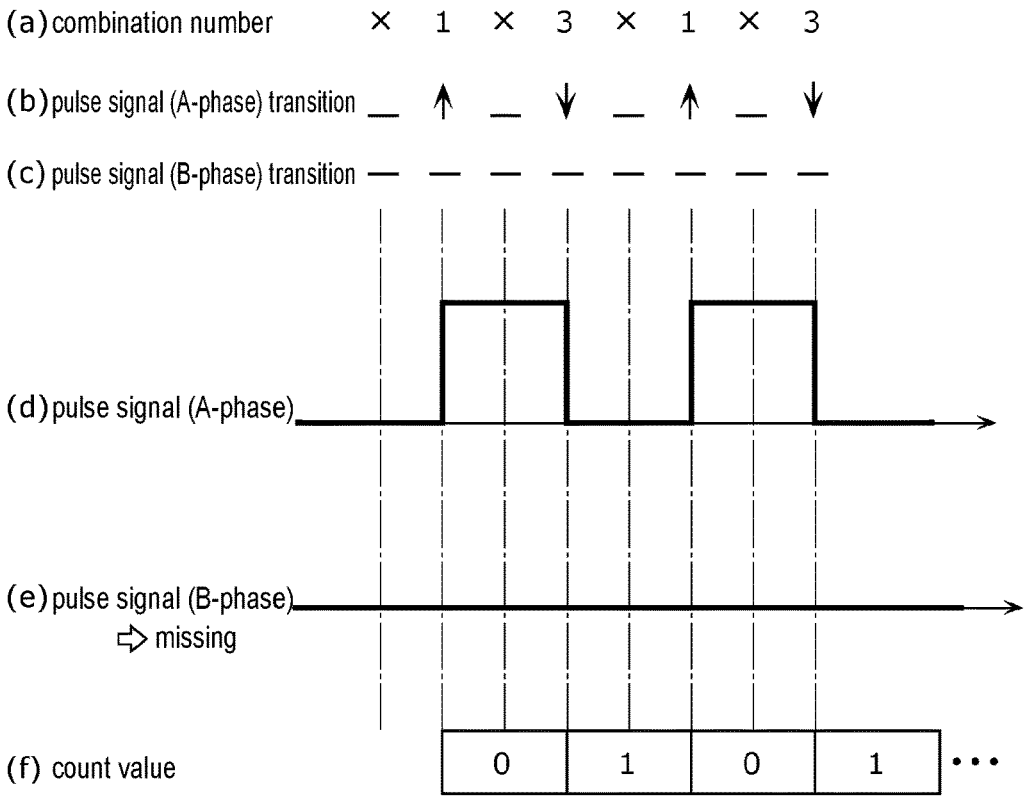
FIG. 5D is a diagram showing a relationship between pulse signals from the Y-axis encoder and count values counted by the Y-axis counter according to Embodiment 1.

Further, when the Y-axis encoder 68 is abnormal (A-phase pulse signal is missing) and the head part 20 is moving forward or backward in the sub-scanning direction, as shown in (d) and (e) of FIG. 5C, the Y-axis encoder 68 outputs only a B-phase pulse signal.

Here, as shown in (a) to (c) of FIG. 5C, as the combination of the transition of each waveform of the A-phase pulse signal and the B-phase pulse signal, there are two kinds of combinations: i) the A-phase pulse signal is constant, and the B-phase pulse signal rises (combination number=2); and ii) the A-phase pulse signal is constant, and the B-phase pulse signal falls (combination number=4).

In this case, as shown in (f) of FIG. 5C, the Y-axis counter 70 counts up and counts down the count value repeatedly in a manner such as "1"→"0"→"1"→"0" . . . at each timing of the rise edge and the fall edge of the B-phase pulse signal.

Further, when the Y-axis encoder 68 is abnormal (B-phase pulse signal is missing) and the head part 20 is moving forward or backward in the sub-scanning direction, as shown in (d) and (e) of FIG. 5D, the Y-axis encoder 68 outputs only an A-phase pulse signal.

Here, as shown in (a) to (c) of FIG. 5D, as the combination of the transition of each waveform of the A-phase pulse signal and the B-phase pulse signal, there are two kinds of combinations: i) the A-phase pulse signal rises, and the B-phase pulse signal is constant (combination number=1); and ii) the A-phase pulse signal falls, and the B-phase pulse signal is constant (combination number=3).

In this case, as shown in (f) of FIG. 5D, the Y-axis counter 70 counts up and counts down the count value repeatedly in a manner such as "0"→"1"→"0"→"1" . . . at each timing of the rise edge and the fall edge of the A-phase pulse signal.

Further, although not shown, when the Y-axis encoder 68 is abnormal (both the A-phase pulse signal and the B-phase pulse signal are missing) and the head part 20 is moving forward or backward in the sub-scanning direction, the Y-axis encoder 68 outputs neither the A-phase pulse signal nor the B-phase pulse signal. In this case, the count value counted by the Y-axis counter 70 is constant at "0" in a manner such as "0"→"0"→"0"→"0" . . . .

Returning to FIG. 4, in a first control (described later) by the control part 74, when the head part 20 is moving forward in the sub-scanning direction, the determination part 72 determines whether or not there is an abnormality in the Y-axis encoder 68 based on the count value counted up by the Y-axis counter 70.

Specifically, when the Y-axis counter 70 counts up to a count value equal to or greater than 4 (an example of being equal to or greater than a predetermined number) in a manner such as the count value "1"→"2"→"3"→"4" . . . shown in (f) of FIG. 5A, the determination part 72 determines that the Y-axis encoder 68 is normal. In addition, counting up to a count value equal to or greater than 4 means that there are four kinds of combinations of the transition of each waveform of the A-phase pulse signal and the B-phase pulse signal, as shown in FIG. 5A for example. Therefore, it is considered that both the A-phase pulse signal and the B-phase pulse signal are normally output from the Y-axis encoder 68.

Meanwhile, when the Y-axis counter 70 counts up to a count value less than 4 (an example of being less than the predetermined number) in a manner such as the count value "0"→"1" shown in (f) of FIG. 5C and (f) of FIG. 5D, the determination part 72 determines that the Y-axis encoder 68 is abnormal. In addition, counting up to a count value less than 4 means that there are not four combinations of the transition of each waveform of the A-phase pulse signal and the B-phase pulse signal, as shown in FIG. 5C and FIG. 5D for example. Therefore, it is considered that at least one of the A-phase pulse signal and the B-phase pulse signal is not normally output from the Y-axis encoder 68.

The control part 74 performs the first control and a second control.

The first control is a control for driving the Y-axis driving part 66 (Y-axis motor 40) in order to determine in advance whether or not there is an abnormality in the Y-axis encoder 68 by the determination part 72 before the second control (for example, a printing operation). In the first control, the control part 74 drives the Y-axis driving part 66 so as to apply a constant voltage (for example, about 9.6 V) to the Y-axis motor 40 for a first time (for example, 30 milliseconds) regardless of the count value from the Y-axis counter 70. That is, in the first control, the control part 74 does not perform feedback control based on the count value from the Y-axis counter 70 when driving the Y-axis driving part 66. Thereby, in the first control, the head part 20 moves forward in the sub-scanning direction by a first distance (for example, 1 mm or less). In addition, the first time is, for example, a constant time measured by a timer.

The second control is control for driving the head part 20, the X-axis driving part 60 (X-axis motor 32) and the Y-axis driving part 66 (Y-axis motor 40) in order that the nail 10 of the finger 8 is printed based on the image data from the image processing part 58 after the first control. In the second control, the control part 74 drives the X-axis driving part 60 so as to apply a predetermined voltage to the X-axis motor 32 for a second time (for example, several seconds to several tens of seconds) longer than the first time based on the count value from the X-axis counter 64. That is, in the second control, the control part 74 performs feedback control based on the count value from the X-axis counter 64 when driving the X-axis driving part 60. Further, in the second control, the control part 74 drives the Y-axis driving part 66 so as to apply a predetermined voltage to the Y-axis motor 40 for the second time longer than the first time based on the count value from the Y-axis counter 70. That is, in the second control, the control part 74 performs the feedback control based on the count value from the Y-axis counter 70 when driving the Y-axis driving part 66. Thereby, in the second control, the head part 20 moves forward in the sub-scanning direction by a second distance (for example, several centimeters) longer than the first distance.

When the determination part 72 determines in the first control that the Y-axis encoder 68 is normal, the control part 74 shifts from the first control to the second control. Meanwhile, when the determination part 72 determines in the first control that the Y-axis encoder 68 is abnormal, the control part 74 does not shift from the first control to the second control. Thereby, the control part 74 does not execute, for example, a printing operation as the second control.

1-3. Operation of Printing Device

Figure 6:
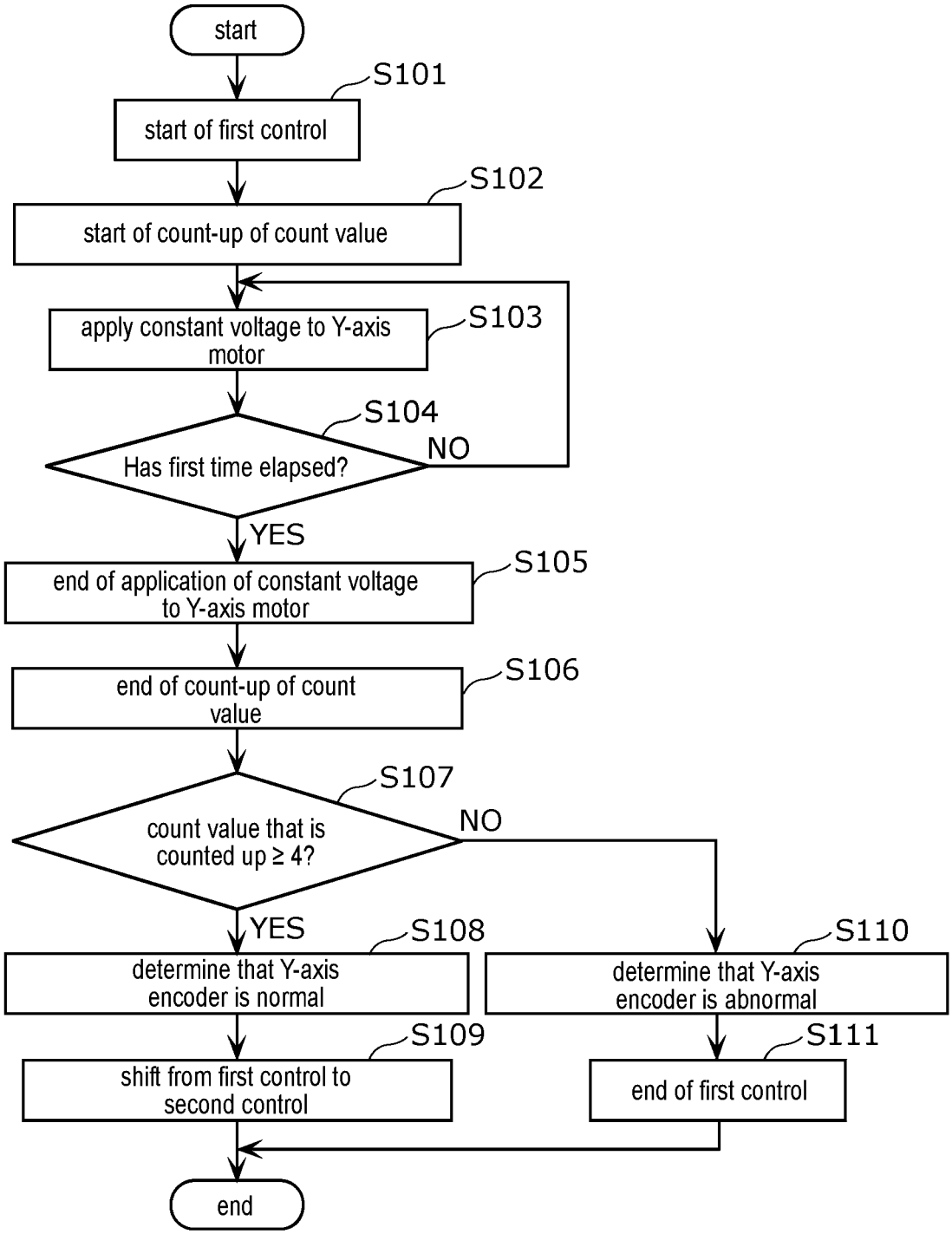
FIG. 6 is a flowchart showing the flow of the operation of the printing device according to Embodiment 1.
Figure 7A:
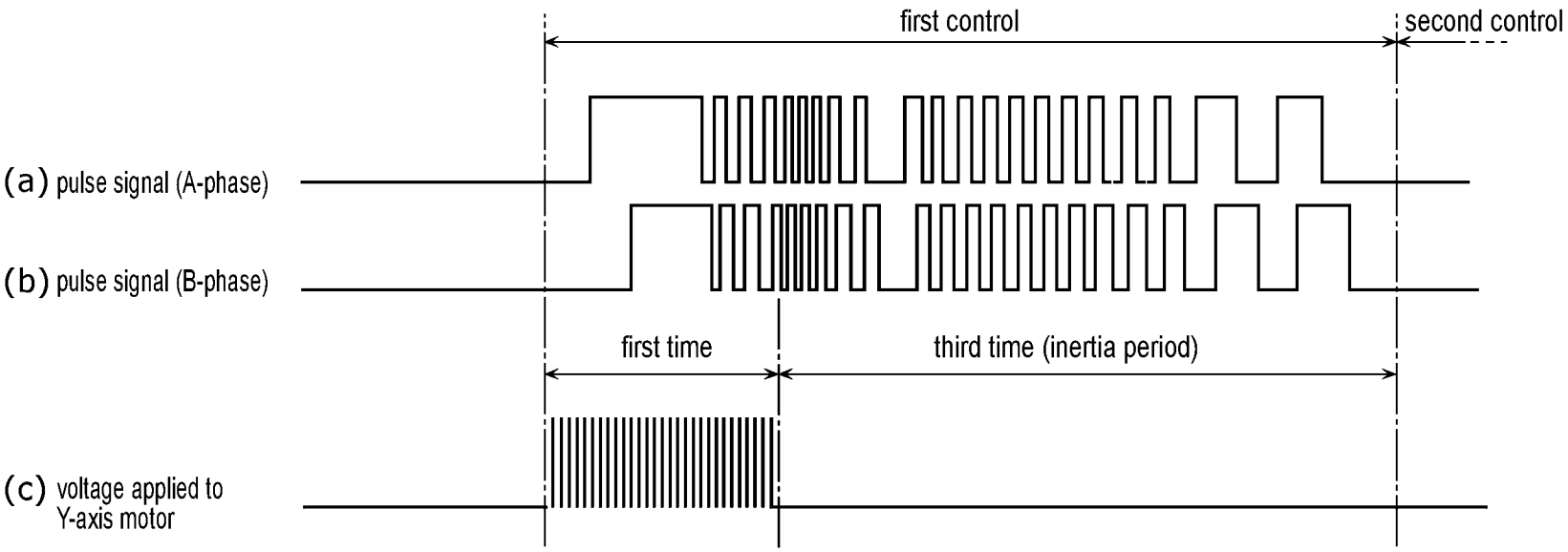
FIG. 7A is a diagram for explaining the operation of the printing device according to Embodiment 1 when the Y-axis encoder is normal.
Figure 7B:
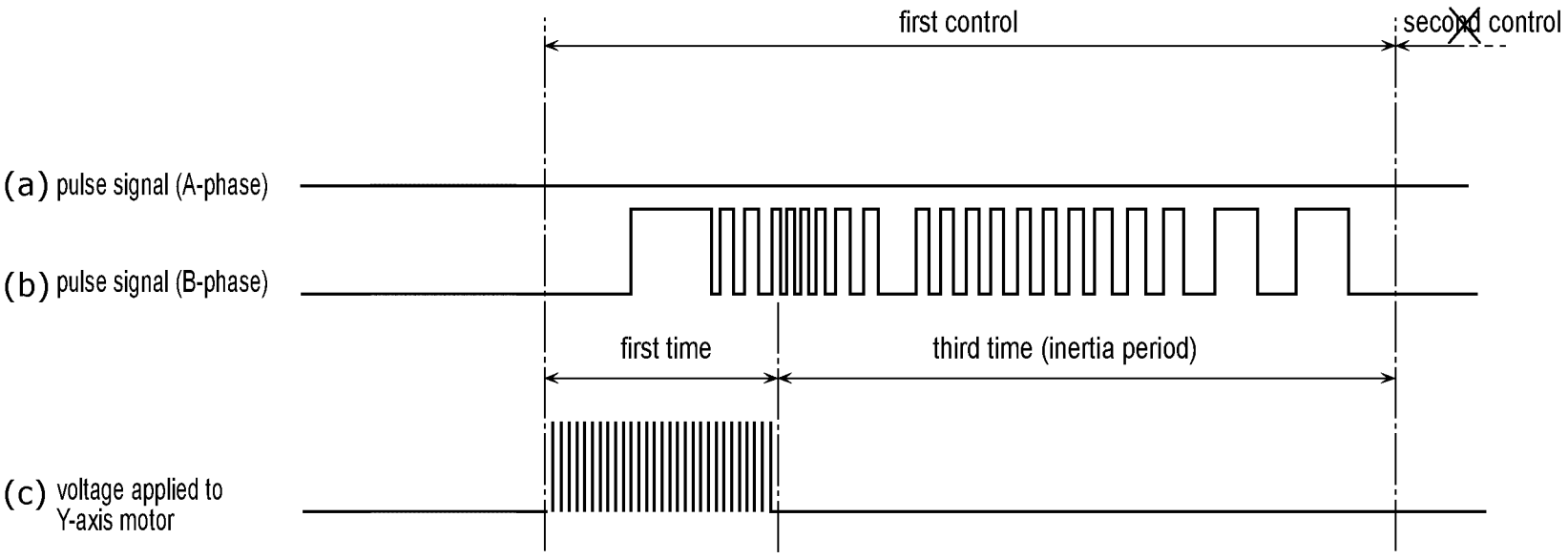
FIG. 7B is a diagram for explaining the operation of the printing device according to Embodiment 1 when the Y-axis encoder is abnormal.

Next, the operation of the printing device 2 according to Embodiment 1 is described with reference to FIG. 6 to FIG. 7B. FIG. 6 is a flowchart showing the flow of the operation of the printing device 2 according to Embodiment 1. FIG. 7A is a diagram for explaining the operation of the printing device 2 according to Embodiment 1 when the Y-axis encoder 68 is normal. FIG. 7B is a diagram for explaining the operation of the printing device 2 according to Embodiment 1 when the Y-axis encoder 68 is abnormal.

As shown in FIG. 6, first, the first control by the control part 74 starts (S101), and the count-up of the count value by the Y-axis counter 70 starts (S102). As shown in (c) of FIG. 7A and (c) of FIG. 7B, the control part 74 drives the Y-axis driving part 66 so as to apply the constant voltage to the Y-axis motor 40 for the first time regardless of the count value from the Y-axis counter 70 (S103). Thereby, the head part 20 moves forward in the sub-scanning direction.

Here, when the Y-axis encoder 68 is normal, as shown in (a) and (b) of FIG. 7A, both the A-phase pulse signal and the B-phase pulse signal are output from the Y-axis encoder 68. Meanwhile, when the Y-axis encoder 68 is abnormal, as shown in (a) and (b) of FIG. 7B, the A-phase pulse signal is not output from the Y-axis encoder 68; alternatively, although not shown, the B-phase pulse signal (or both the A-phase pulse signal and the B-phase pulse signal) is not output from the Y-axis encoder 68.

When the first time has not elapsed since the constant voltage was applied to the Y-axis motor 40 (NO in S104), the operation returns to step S103 described above. When the first time has elapsed since the constant voltage was applied to the Y-axis motor 40 (YES in S104), the control part 74 ends the application of the constant voltage to the Y-axis motor 40 by stopping the driving of the Y-axis driving part 66 (S105). In addition, during the first time in which the constant voltage is applied to the Y-axis motor 40, the head part 20 moves forward in the sub-scanning direction due to the driving force from the Y-axis driving part 66. During a third time (for example, 70 milliseconds) (inertia period) in which the constant voltage is not applied to the Y-axis motor 40 after the elapse of the first time, the head part 20 moves forward in the sub-scanning direction due to inertia force. Thereby, the head part 20 moves forward by the first distance (for example, 1 mm or less) in the sub-scanning direction over the first time and the third time.

In the first control, the Y-axis counter 70 counts up the count value over the first time and the third time. When the third time has elapsed, the count-up of the count value by the Y-axis counter 70 ends (S106).

When the Y-axis counter 70 counts up to a count value equal to or greater than 4 over the first time and the third time (YES in S107), the determination part 72 determines that the Y-axis encoder 68 is normal (S108). In this case, the control part 74 shifts from the first control to the second control (S109).

Returning to step S107, when the Y-axis counter 70 counts up to a count value less than 4 over the first time and the third time (NO in S107), the determination part 72 determines that the Y-axis encoder 68 is abnormal (S110). In this case, the control part 74 ends the first control (S111), and does not shift from the first control to the second control.

1-4. Effect

As described above, because the control part 74 performs the first control before the second control, it is possible to determine in advance whether or not there is an abnormality in the Y-axis encoder 68. Thereby, in the second control, it is possible to prevent the driving of the Y-axis driving part 66 by the control part 74 from becoming uncontrollable.

Further, in the first control, the control part 74 does not perform the feedback control which drives the Y-axis driving part 66 based on the count value from the Y-axis counter 70. Thereby, even if the Y-axis encoder 68 breaks down, it is possible to cause the head part 20 to move by the first distance (for example, 1 mm or less) necessary for detecting whether or not there is an abnormality in the Y-axis encoder 68 without causing the head part 20 to run away. As a result, it is possible to prevent the moving table 28 from running away forward in the sub-scanning direction and contacting with the nail 10 of the finger 8.

Embodiment 2

2-1. Function Configuration of Printing Device

Figure 8:
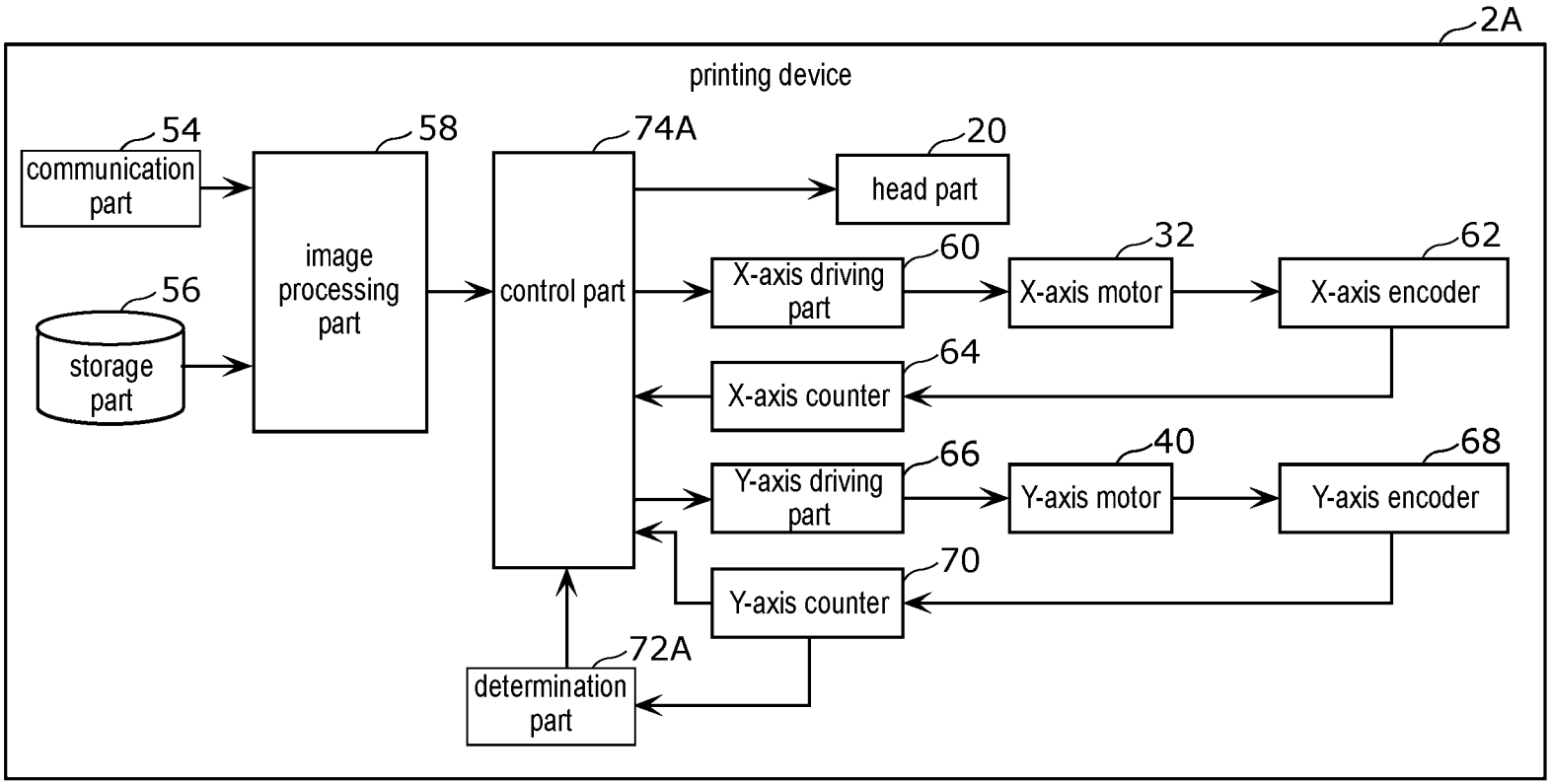
FIG. 8 is a block diagram showing the function configuration of a printing device according to Embodiment 2.

The function configuration of a printing device 2A according to Embodiment 2 is described with reference to FIG. 8. FIG. 8 is a block diagram showing the function configuration of the printing device 2A according to Embodiment 2. In addition, in each of the following embodiments, the same constituent components as those in the above-described Embodiment 1 are designated by the same reference numerals, and the description thereof is omitted.

In Embodiment 1, in the first control, the control part 74 drives the Y-axis driving part 66 in order that the head part 20 moves forward in the sub-scanning direction. Conversely, as shown in FIG. 8, in the first control, a control part 74A of the printing device 2A according to Embodiment 2 drives the Y-axis driving part 66 in order that the head part 20 moves backward in the sub-scanning direction.

In the first control by the control part 74A, when the head part 20 is moving backward in the sub-scanning direction, a determination part 72A determines whether or not there is an abnormality in the Y-axis encoder 68 based on the count value counted down by the Y-axis counter 70.

Specifically, when the Y-axis counter 70 counts down to a count value equal to or greater than 4 in a manner such as the count value "7"→"6"→"5"→"4" . . . shown in (f) of FIG. 5B described above, the determination part 72A determines that the Y-axis encoder 68 is normal. In addition, counting down to a count value equal to or greater than 4 means that there are four combinations of the transition of each waveform of the A-phase pulse signal and the B-phase pulse signal as shown in FIG. 5B, so that it is considered that both the A-phase pulse signal and the B-phase pulse signal are normally output from the Y-axis encoder 68.

2-2. Operation of Printing Device

Figure 9:
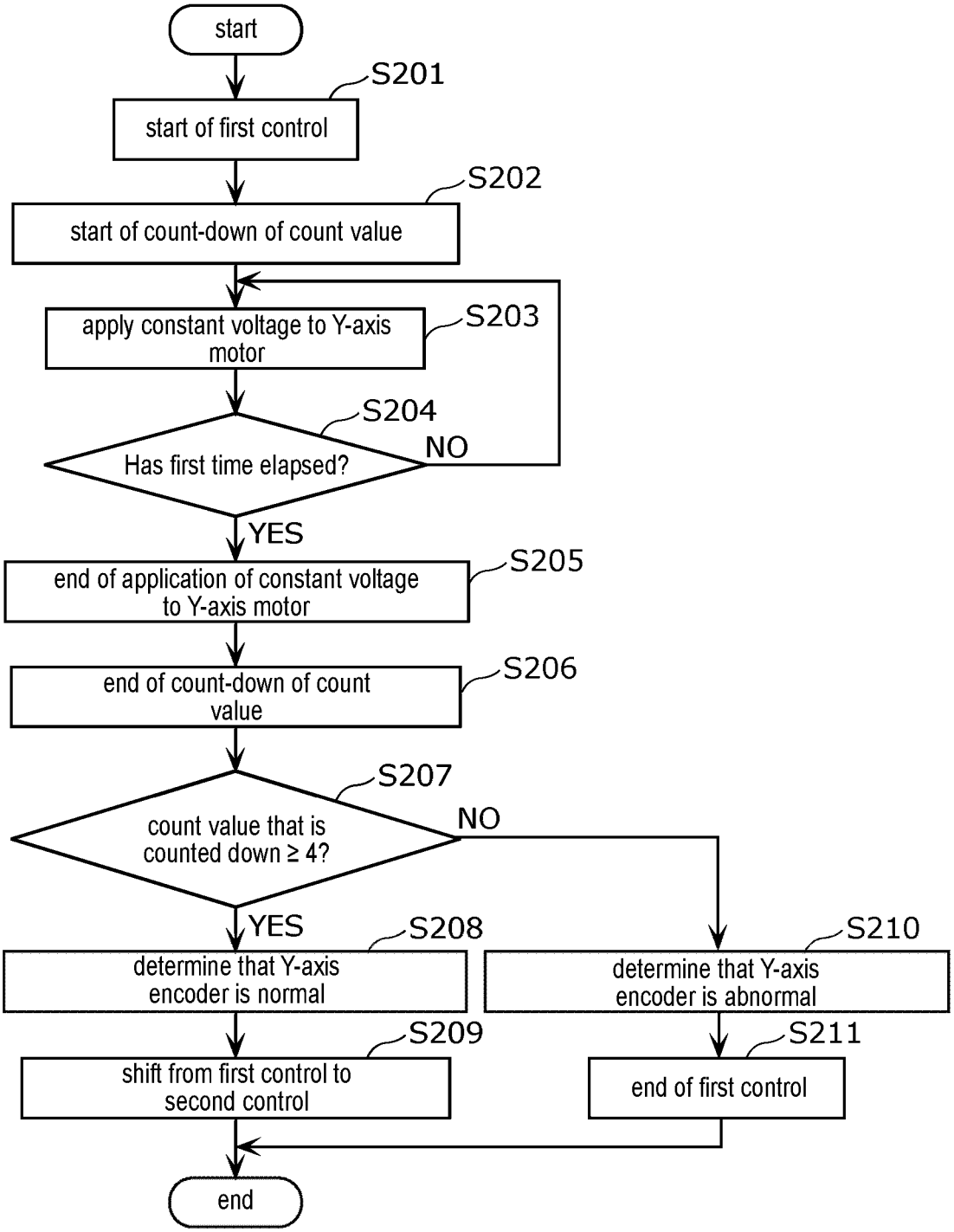
FIG. 9 is a flowchart showing the flow of the operation of the printing device according to Embodiment 2.
Figure 10:
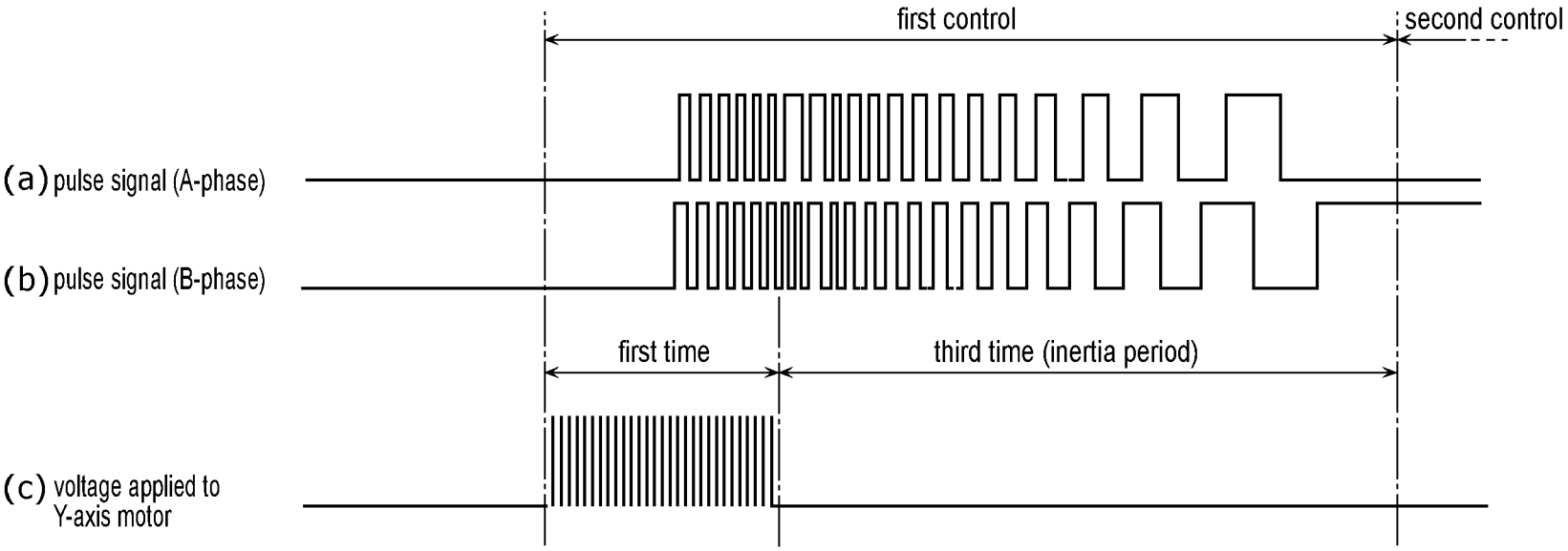
FIG. 10 is a diagram for explaining the operation of the printing device according to Embodiment 2 when the Y-axis encoder is normal.

Next, the operation of the printing device 2A according to Embodiment 2 is described with reference to FIG. 9 and FIG. 10. FIG. 9 is a flowchart showing the flow of the operation of the printing device 2A according to Embodiment 2. FIG. 10 is a diagram for explaining the operation of the printing device 2A according to Embodiment 2 when the Y-axis encoder 68 is normal.

As shown in FIG. 9, first, the first control by the control part 74A starts (S201), and the count-down of the count value by the Y-axis counter 70 starts (S202). As shown in (c) of FIG. 10, the control part 74A drives the Y-axis driving part 66 so as to apply a constant voltage to the Y-axis motor 40 for a first time regardless of the count value from the Y-axis counter 70 (S203). Thereby, the head part 20 moves backward in the sub-scanning direction.

Here, when the Y-axis encoder 68 is normal, as shown in (a) and (b) of FIG. 10, both the A-phase pulse signal and the B-phase pulse signal are output from the Y-axis encoder 68. Meanwhile, although not shown, when the Y-axis encoder 68 is abnormal, at least one of the A-phase pulse signal and the B-phase pulse signal is not output from the Y-axis encoder 68.

When the first time (for example, 30 milliseconds) has not elapsed since the constant voltage was applied to the Y-axis motor 40 (NO in S204), the operation returns to step S203 described above. When the first time has elapsed since the constant voltage was applied to the Y-axis motor 40 (YES in S204), the control part 74A ends the application of the constant voltage to the Y-axis motor 40 by stopping the driving of the Y-axis driving part 66 (S205). In addition, during the first time in which the constant voltage is applied to the Y-axis motor 40, the head part 20 moves backward in the sub-scanning direction due to the driving force from the Y-axis driving part 66. During a third time (for example, 70 milliseconds) (inertia period) in which the constant voltage is not applied to the Y-axis motor 40 after the elapse of the first time, the head part 20 moves backward in the sub-scanning direction due to inertia force. Thereby, the head part 20 moves backward by a first distance (for example, 1 mm or less) in the sub-scanning direction over the first time and the third time.

In the first control, the Y-axis counter 70 counts down the count value over the first time and the third time. When the third time has elapsed, the count-down of the count value by the Y-axis counter 70 ends (S206).

When the Y-axis counter 70 counts down to a count value equal to or greater than 4 over the first time and the third time (YES in S207), the determination part 72A determines that the Y-axis encoder 68 is normal (S208). In this case, the control part 74A shifts from the first control the second control (S209).

Returning to step S207, when the Y-axis counter 70 counts down to a count value less than 4 over the first time and the third time (NO in S207), the determination part 72A determines that the Y-axis encoder 68 is abnormal (S210). In this case, the control part 74A ends the first control (S211) and does not shift from the first control to the second control.

2-3. Effect

In the embodiment, it is also possible to obtain the same effect as that of Embodiment 1.

Embodiment 3

3-1. Function Configuration of Printing Device

Figure 11:
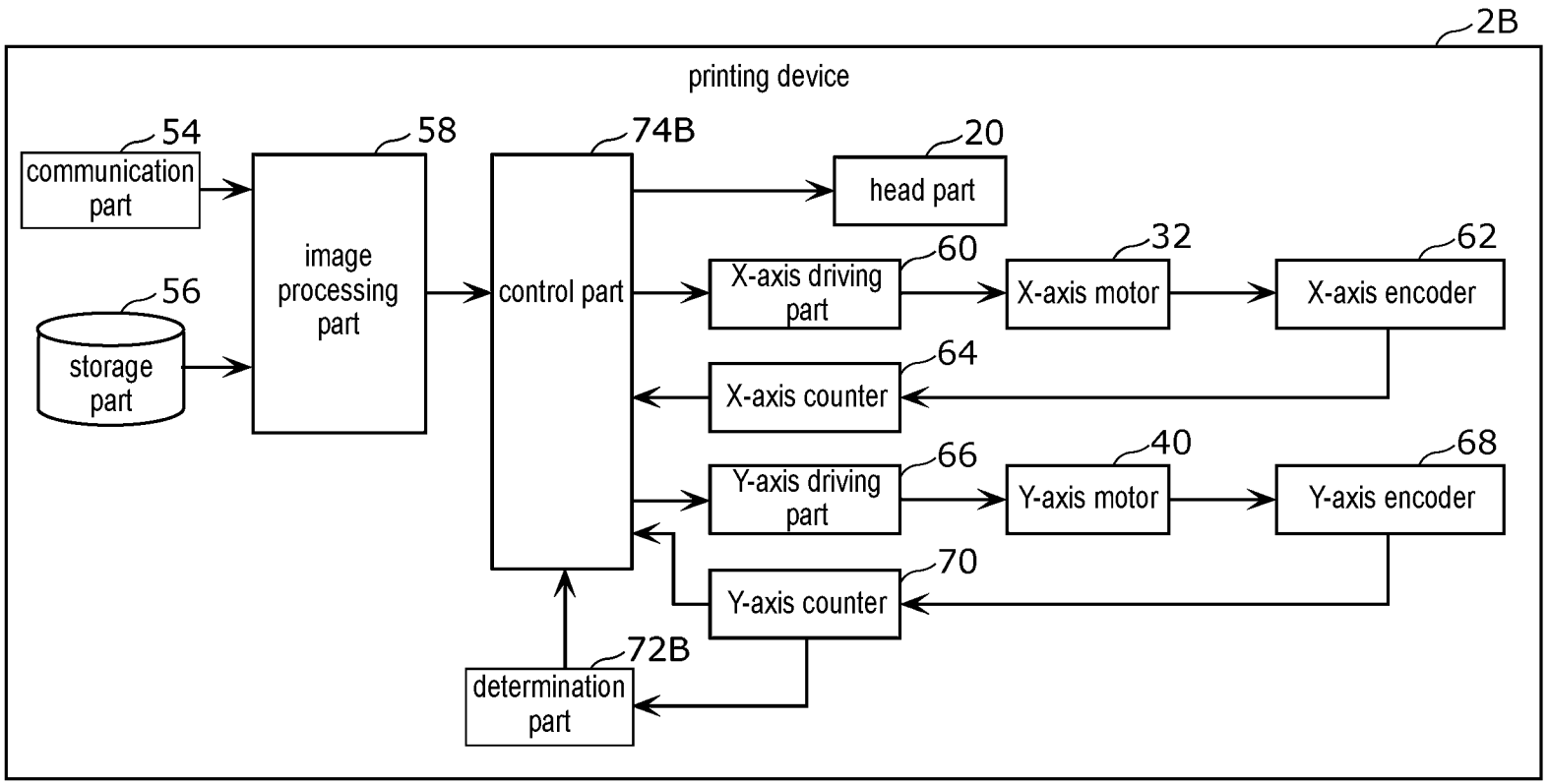
FIG. 11 is a block diagram showing the function configuration of a printing device according to Embodiment 3.

The function configuration of a printing device 2B according to Embodiment 3 is described with reference to FIG. 11. FIG. 11 is a block diagram showing the function configuration of the printing device 2B according to Embodiment 3.

As shown in FIG. 11, in the first control, a control part 74B of the printing device 2B according to Embodiment 3 drives the Y-axis driving part 66 in order that the head part 20 moves forward in the sub-scanning direction (an example of a first direction). At this time, the control part 74B reverses the moving direction of the head part 20 in accordance with the count value counted by the Y-axis counter 70 and drives the Y-axis driving part 66 in order that the head part 20 moves backward in the sub-scanning direction (an example of a second direction).

In the first control, when the head part 20 is moving forward or backward in the sub-scanning direction, a determination part 72B determines whether or not there is an abnormality in the Y-axis encoder 68 based on the count value counted by the Y-axis counter 70.

3-2. Operation of Printing Device

Figure 12:
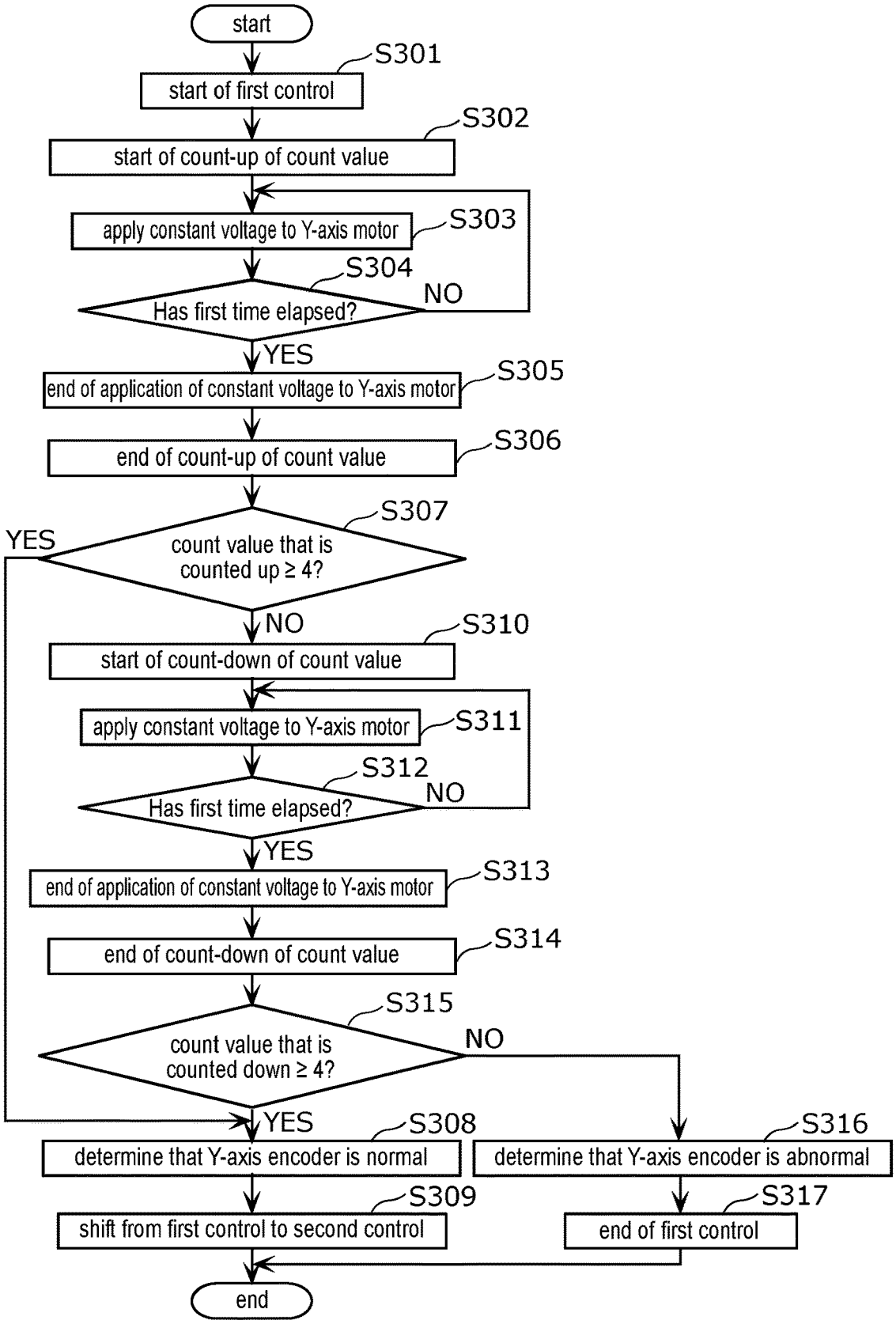
FIG. 12 is a flowchart showing the flow of the operation of the printing device according to Embodiment 3.
Figure 13:
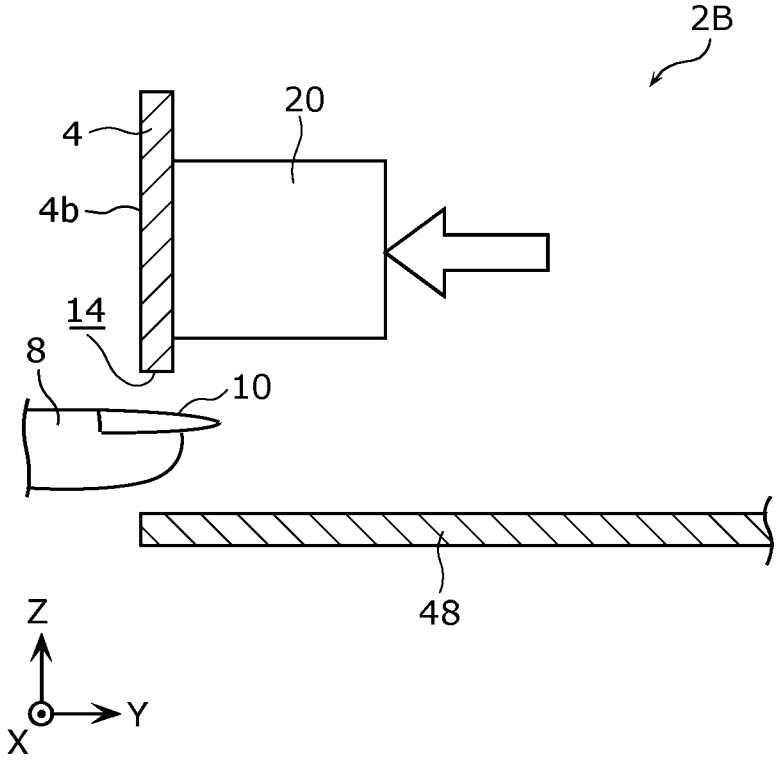
FIG. 13 is a diagram for explaining the operation of the printing device according to Embodiment 3.

Next, the operation of the printing device 2B according to Embodiment 3 is described with reference to FIG. 12 and FIG. 13. FIG. 12 is a flowchart showing the flow of the operation of the printing device 2B according to Embodiment 3. FIG. 13 is a diagram for explaining the operation of the printing device 2B according to Embodiment 3.

As shown in FIG. 12, first, the first control by the control part 74B starts (S301), and the count-up of the count value by the Y-axis counter 70 starts (S302). The control part 74B drives the Y-axis driving part 66 so as to apply a constant voltage to the Y-axis motor 40 for a first time regardless of the count value from the Y-axis counter 70 (S303). Thereby, the head part 20 moves forward in the sub-scanning direction.

When the first time has not elapsed since the constant voltage was applied to the Y-axis motor 40 (NO in S304), the operation returns to step S303 described above. When the first time has elapsed since the constant voltage was applied to the Y-axis motor 40 (YES in S304), the control part 74B ends the application of the constant voltage to the Y-axis motor 40 by stopping the driving of the Y-axis driving part 66 (S305).

In the first control, the Y-axis counter 70 counts up the count value over the first time and a third time (inertia period). When the third time has elapsed, the count-up of the count value by the Y-axis counter 70 ends (S306).

When the Y-axis counter 70 counts up to a count value equal to or greater than 4 over the first time and the third time (YES in S307), the determination part 72B determines that the Y-axis encoder 68 is normal (S308). In this case, the control part 74B shifts from the first control to the second control (S309).

Returning to step S307, when the Y-axis counter 70 counts up to a count value less than 4 over the first time and the third time (NO in S307), the count-down of the count value by the Y-axis counter 70 starts (S310). In addition, at this timing, the determination part 72B does not determine that the Y-axis encoder 68 is abnormal.

In addition, in the first control, when the Y-axis counter 70 counts up to a count value less than 4, it is not possible to determine whether it is a) a case in which the Y-axis encoder 68 is normal, but as shown in FIG. 13 for example, the head part 20 contacts with the front surface 4*b* of the housing 4 and cannot physically move, or b) a case in which the Y-axis encoder 68 is abnormal. Therefore, in this case, as described below, whether or not there is an abnormality in the Y-axis encoder 68 is determined after reversing the moving direction of the head part 20 from the front to the back in the sub-scanning direction.

The control part 74B drives the Y-axis driving part 66 so as to apply the constant voltage to the Y-axis motor 40 for the first time regardless of the count value from the Y-axis counter 70 (S311). Thereby, the head part 20 moves backward in the sub-scanning direction.

When the first time has not elapsed since the constant voltage was applied to the Y-axis motor 40 (NO in S312), the operation returns to step S311 described above. When the first time has elapsed since the constant voltage was applied to the Y-axis motor 40 (YES in S312), the control part 74B ends the application of the constant voltage to the Y-axis motor 40 by stopping the driving of the Y-axis driving part 66 (S313).

In the first control, the Y-axis counter 70 counts down the count value over the first time and the third time (inertia period). When the third time has elapsed, the count-down of the count value by the Y-axis counter 70 ends (S314).

When the Y-axis counter 70 counts down to a count value equal to or greater than 4 over the first time and the third time (YES in S315), the determination part 72B determines that the Y-axis encoder 68 is normal (S308). In this case, the control part 74B shifts from the first control to the second control (S309).

Returning to step S315, when the Y-axis counter 70 counts down to a count value less than 4 over the first time and the third time (NO in S315), the determination part 72B determines that the Y-axis encoder 68 is abnormal (S316). In this case, the control part 74B ends the first control (S317), and does not shift from the first control to the second control.

3-3. Effect

In the embodiment, when the Y-axis encoder 68 is normal, but as shown in FIG. 13 for example, the head part 20 contacts with the front surface 4*b* of the housing 4 and cannot physically move, it is possible to prevent the determination part 72B from erroneously determining the abnormality of the Y-axis encoder 68.

In addition, when a sensor or the like which detects that the head part 20 is in contact with the front surface 4*b* of the housing 4 is arranged inside the housing 4, based on a detection result from the sensor or the like, the control part 74B may cause the head part 20 to only move backward in the sub-scanning direction without causing the head part 20 to move forward in the sub-scanning direction. That is, steps S302 to S307 described above may be omitted.

Embodiment 4

4-1. Function Configuration of Printing Device

Figure 14:
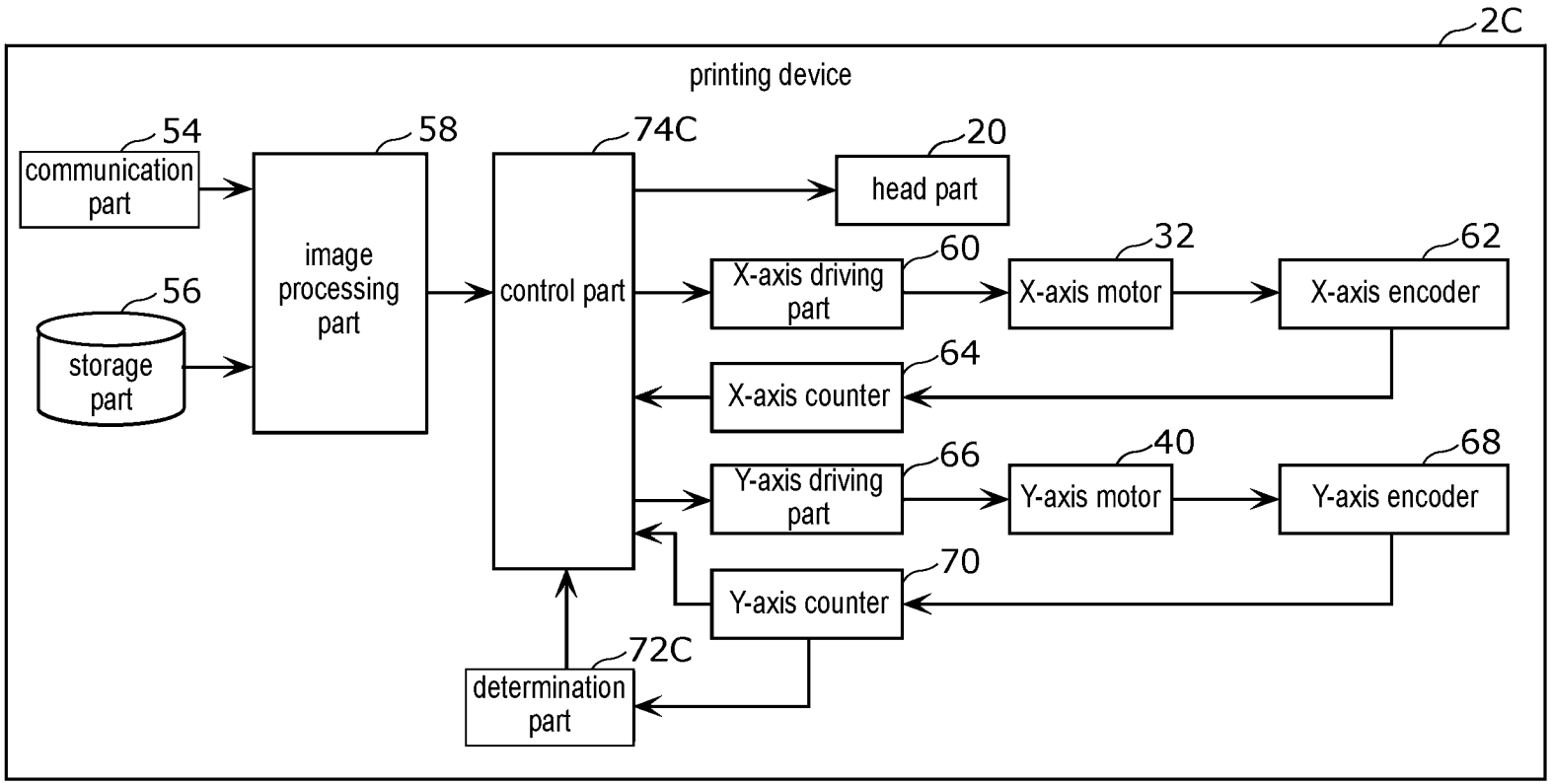
FIG. 14 is a block diagram showing the function configuration of a printing device according to Embodiment 4.

The function configuration of a printing device 2C according to Embodiment 4 is described with reference to FIG. 14. FIG. 14 is a block diagram showing the function configuration of the printing device 2C according to Embodiment 4.

As shown in FIG. 14, in the first control, a control part 74C of the printing device 2C according to Embodiment 4 drives the Y-axis driving part 66 in order that the head part 20 moves backward in the sub-scanning direction (an example of the first direction). At this time, the control part 74C reverses the moving direction of the head part 20 in accordance with the count value counted by the Y-axis counter 70 and drives the Y-axis driving part 66 in order that the head part 20 moves forward in the sub-scanning direction (an example of the second direction).

In the first control, when the head part 20 is moving forward or backward in the sub-scanning direction, a determination part 72C determines whether or not there is an abnormality in the Y-axis encoder 68 based on the count value counted by the Y-axis counter 70.

4-2. Operation of Printing Device

Figure 15:
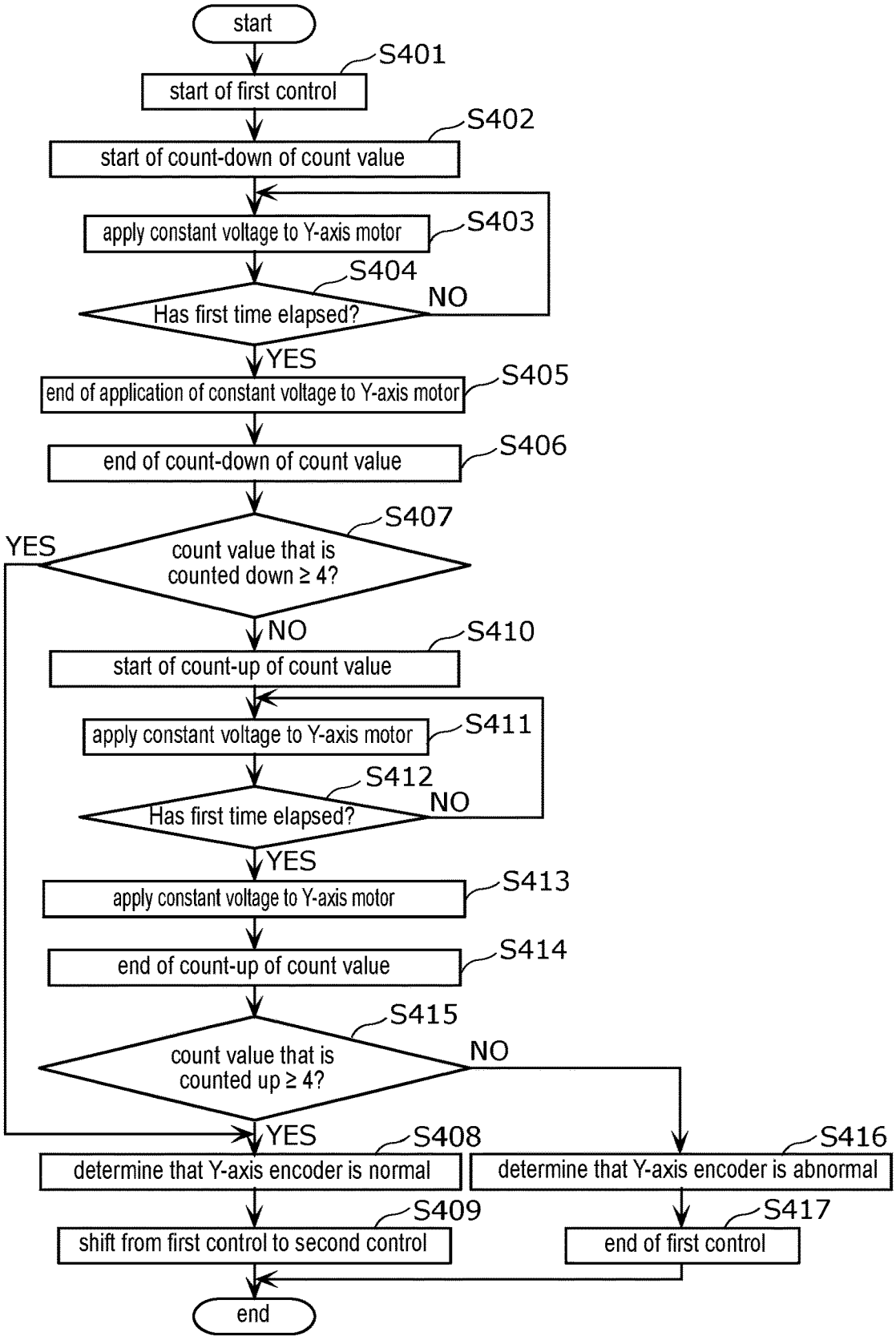
FIG. 15 is a flowchart showing the flow of the operation of the printing device according to Embodiment 4.
Figure 16:
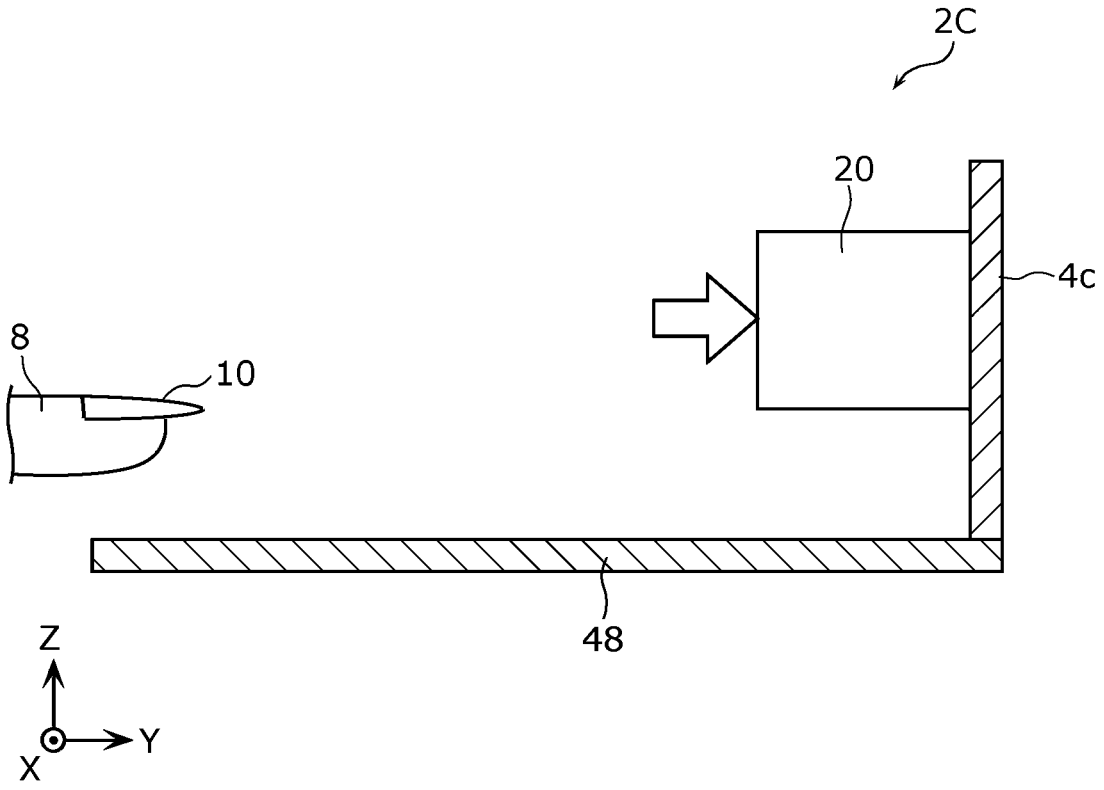
FIG. 16 is a diagram for explaining the operation of the printing device according to Embodiment 4.

Next, the operation of the printing device 2C according to Embodiment 4 is described with reference to FIG. 15 and FIG. 16. FIG. 15 is a flowchart showing the flow of the operation of the printing device 2C according to Embodiment 4. FIG. 16 is a diagram for explaining the operation of the printing device 2C according to Embodiment 4.

As shown in FIG. 15, first, the first control by the control part 74C starts (S401), and the count-down of the count value by the Y-axis counter 70 starts (S402). The control part 74C drives the Y-axis driving part 66 so as to apply a constant voltage to the Y-axis motor 40 for a first time regardless of the count value from the Y-axis counter 70 (S403). Thereby, the head part 20 moves backward in the sub-scanning direction.

When the first time has not elapsed since the constant voltage was applied to the Y-axis motor 40 (NO in S404), the operation returns to step S403 described above. When the first time has elapsed since the constant voltage was applied to the Y-axis motor 40 (YES in S404), the control part 74C ends the application of the constant voltage to the Y-axis motor 40 by stopping the driving of the Y-axis driving part 66 (S405).

In the first control, the Y-axis counter 70 counts down the count value over the first time and a third time (inertia period). When the third time has elapsed, the count-down of the count value by the Y-axis counter 70 ends (S406).

When the Y-axis counter 70 counts down to a count value equal to or greater than 4 over the first time and the third time (YES in S407), the determination part 72C determines that the Y-axis encoder 68 is normal (S408). In this case, the control part 74C shifts from the first control to the second control (S409).

Returning to step S407, when the Y-axis counter 70 counts down to a count value less than 4 over the first time and the third time (NO in S407), the count-up of the count value by the Y-axis counter 70 starts (S410). In addition, at this timing, the determination part 72C does not determine that the Y-axis encoder 68 is abnormal.

In addition, in the first control, when the Y-axis counter 70 counts down to a count value less than 4, it is not possible to determine whether it is a) a case in which the Y-axis encoder 68 is normal, but as shown in FIG. 16 for example, the head part 20 contacts with a rear surface 4*c* (a surface opposite to the front surface 4*b*) of the housing 4 and cannot physically move, orb) a case in which the Y-axis encoder 68 is abnormal. Therefore, in this case, as described below, whether or not there is an abnormality in the Y-axis encoder 68 is determined after reversing the moving direction of the head part 20 from the back to the front in the sub-scanning direction.

The control part 74C drives the Y-axis driving part 66 so as to apply the constant voltage to the Y-axis motor 40 for the first time regardless of the count value from the Y-axis counter 70 (S411). Thereby, the head part 20 moves forward in the sub-scanning direction.

When the first time has not elapsed since the constant voltage was applied to the Y-axis motor 40 (NO in S412), the operation returns to step S411 described above. When the first time has elapsed since the constant voltage was applied to the Y-axis motor 40 (YES in S412), the control part 74C ends the application of the constant voltage to the Y-axis motor 40 by stopping the driving of the Y-axis driving part 66 (S413).

In the first control, the Y-axis counter 70 counts up the count value over the first time and the third time (inertia period). When the third time has elapsed, the count-up of the count value by the Y-axis counter 70 ends (S414).

When the Y-axis counter 70 counts up to a count value equal to or greater than 4 over the first time and the third time (YES in S415), the determination part 72C determines that the Y-axis encoder 68 is normal (S408). In this case, the control part 74C shifts from the first control to the second control (S409).

Returning to step S415, when the Y-axis counter 70 counts up to a count value less than 4 over the first time and the third time (NO in S415), the determination part 72C determines that the Y-axis encoder 68 is abnormal (S416). In this case, the control part 74C ends the first control (S417) and does not shift from the first control to the second control.

4-3. Effect

In the embodiment, when the Y-axis encoder 68 is normal, but as shown in FIG. 16 for example, the head part 20 contacts with the rear surface 4*c* of the housing 4 and cannot physically move, it is possible to prevent the determination part 72C from erroneously determining the abnormality of the Y-axis encoder 68.

In addition, when a sensor or the like which detects that the head part 20 is in contact with the rear surface 4*c* of the housing 4 is arranged inside the housing 4, based on a detection result from the sensor or the like, the control part 74C may cause the head part 20 to only move forward in the sub-scanning direction without causing the head part 20 to move backward in the sub-scanning direction. That is, steps S402 to S407 described above may be omitted.

Modification Example

In the above, the printing devices according to the first to fourth embodiments of the disclosure have been described, but the disclosure is not limited to each of the above embodiments. For example, each of the above embodiments may be combined respectively.

In each of the above embodiments, the determination part 72 (72A, 72B, 72C) determines whether or not there is an abnormality in the Y-axis encoder 68 when the head part 20 moves in the sub-scanning direction, but the disclosure is not limited to this. For example, a determination may be made on whether or not there is an abnormality in the X-axis encoder 62 when the head part 20 moves in the main scanning direction (an example of the predetermined direction). Alternatively, when the head part 20 moves in a vertical direction (Z-axis direction) (an example of the predetermined direction), the determination part 72 (72A, 72B, 72C) may determine whether or not there is an abnormality in a Z-axis encoder (not shown) which outputs a pulse signal corresponding to the position of the head part 20 in the vertical direction. In these cases, the same effect as described above can also be obtained.

In each of the above embodiments, the Y-axis encoder 68 is a circular rotary encoder, but the disclosure is not limited to this. The Y-axis encoder 68 may be, for example, a band-shaped linear encoder as long as it outputs a pulse signal corresponding to the position of the head part 20 in the sub-scanning direction.

In each of the above embodiments, the determination part 72 (72A, 72B, 72C) determines whether or not there is an abnormality in the Y-axis encoder 68 based on the absolute value of the count value counted by the Y-axis counter 70, but the disclosure is not limited to this. When the increasing/decreasing direction of the count value does not match the moving direction of the head part 20, it may be determined that the Y-axis encoder 68 is abnormal.

In each of the above embodiments, a case in which the printing operation is performed in the second control has been described, but the disclosure is not limited to this. In the second control, for example, a start operation or a maintenance operation of the printing device 2 (2A, 2B, 2C) may be performed.

In each of the above embodiments, the Y-axis encoder 68 is configured to output pulse signals of two phases (A-phase pulse signal and B-phase pulse signal), but the disclosure is not limited to this. For example, the Y-axis encoder 68 may be configured to output only one-phase pulse signal or pulse signals of three phases or more.

In each of the above embodiments, the first time is set to be a constant time, but the disclosure is not limited to this. For example, the first time may be changed to be shorter by the control part 74 (74A, 74B, 74C) while an initial rise edge of the A-phase pulse signal or the B-phase pulse signal is detected in the first control.

In each of the above embodiments, the control part 74 (74A, 74B, 74C) performs the second control after the elapse of the third time, but the disclosure is not limited to this. For example, the control part 74 (74A, 74B, 74C) may execute the second control after the elapse of the first time.

The disclosure can be applied as, for example, a printing device for performing printing for manicure use on a nail of a finger of a user's hand, and the like.

Other Configurations

According to one embodiment of the disclosure, a printing device for performing printing on a recording medium is provided and includes: a head part that ejects ink toward the recording medium; a driving source that causes the head part to move in a predetermined direction with respect to the recording medium; an encoder that outputs a pulse signal corresponding to the position of the head part in the predetermined direction; a counter that counts a count value based on the pulse signal from the encoder; a control part that performs a first control which drives the driving source by applying a voltage to the driving source for a first time, and performs a second control which controls the driving source by applying a voltage to the driving source for a second time longer than the first time based on the count value from the counter; and a determination part which determines that the encoder is normal when the counter counts to a count value equal to or greater than a predetermined number and determines that the encoder is abnormal when the counter counts to a count value less than the predetermined number in the first control. The control part shifts from the first control to the second control when the determination part determines that the encoder is normal, and the control part does not shift from the first control to the second control when the determination part determines that the encoder is abnormal.

According to the configuration, when the determination part determines that the encoder is normal in the first control, the control part shifts from the first control to the second control, and when the determination part determines that the encoder is abnormal in the first control, the control part does not shift from the first control to the second control. Thereby, it is possible to determine in advance whether or not there is an abnormality in the encoder before the second control performed by the control part. As a result, in the second control, it is possible to prevent the driving of the driving source by the control part from becoming uncontrollable.

For example, in the printing device according to one embodiment of the disclosure, the encoder may output a first pulse signal and a second pulse signal which have a predetermined phase difference, and the counter may count the count value based on the rise and fall of the first pulse signal and the rise and fall of the second pulse signal.

According to the configuration, when the output of the encoder has a plurality of phases (first pulse signal and second pulse signal), it is possible to determine whether or not there is an abnormality in the encoder for all the phases.

For example, in the printing device according to one embodiment of the disclosure, in the first control, the determination part may determine that the encoder is normal when a count value equal to or greater than 4 is counted, and may determine that the encoder is abnormal when a count value less than 4 is counted.

According to the configuration, when the output of the encoder has a plurality of phases, it is possible to precisely determine whether or not there is an abnormality in the encoder for all the phases.

For example, in the printing device according to one embodiment of the disclosure, in the first control, the control part may drive the driving source by applying a constant voltage to the driving source for the first time regardless of the count value from the counter.

According to the configuration, the control part does not perform a feedback control which drives the driving source based on the count value from the counter in the first control. Thereby, even if the encoder breaks down, it is possible to cause the head part to move by a distance necessary for detecting whether or not there is an abnormality in the encoder without causing the head part to run away.

For example, in the printing device according to one embodiment of the disclosure, in the first control, the control part may drive the driving source so as to cause the head part to move by 1 mm or less by applying the constant voltage to the driving source for the first time.

According to the configuration, in the first control, it is possible to cause the head part to move by 1 mm or less as a minimum distance necessary for detecting whether or not there is an abnormality in the encoder.

For example, in the printing device according to one embodiment of the disclosure, in the first control, the determination part may detect whether or not there is an abnormality in the encoder over the first time in which the control part applies the voltage to the driving source, and a third time in which the control part does not apply the voltage to the driving source after the elapse of the first time.

According to the configuration, in the first control, the determination part detects whether or not there is an abnormality in the encoder over the first time in which the head part moves due to a driving force from the driving source and the third time in which the head part moves due to inertia. Therefore, even when the first time is set to be relatively short (for example, about several tens of milliseconds), it is possible to sufficiently secure a moving distance of the head part for detecting whether or not there is an abnormality in the encoder.

For example, in the printing device according to one embodiment of the disclosure, in the first control, while the control part controls the driving source so as to cause the head part to move in a first direction, the determination part may not determine that the encoder is abnormal when the counter counts to a count value less than the predetermined number, and while the control part continues to controls the driving source so as to cause the head part to move in a second direction opposite to the first direction based on the determination result of the determination part, the determination part may determine that the encoder is abnormal when the counter counts to a count value less than the predetermined number.

According to the configuration, in the first control, when the counter counts to a count value less than the predetermined number, it is not possible to determine whether it is a) a case in which the encoder is normal, but for example, the head part contacts with a housing of the printing device or the like and cannot physically move, or b) a case in which the encoder is abnormal. Therefore, in this case, by determining whether or not there is an abnormality in the encoder after reversing the moving direction of the head part from the first direction to the second direction, it is possible to prevent the determination part from erroneously determining the abnormality of the encoder in the former case described above.

According to the printing device of one embodiment of the disclosure, it is possible to determine in advance whether or not there is an abnormality in the encoder before the second control performed by the control part.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A printing device for performing printing on a recording medium, comprising:

a head part that ejects ink toward the recording medium;

a driving source that causes the head part to move in a predetermined direction with respect to the recording medium;

an encoder that outputs a pulse signal corresponding to a position of the head part in the predetermined direction;

a counter that counts a count value based on the pulse signal from the encoder;

a control part that performs a first control which drives the driving source by applying a voltage to the driving source for a first time, and performs a second control which controls the driving source by applying a voltage to the driving source for a second time longer than the first time based on the count value from the counter; and a determination part which in the first control determines that the encoder is normal when the counter counts to a count value equal to or greater than a predetermined number, and determines that the encoder is abnormal when the counter counts to a count value less than the predetermined number, wherein the control part shifts from the first control to the second control when the determination part determines that the encoder is normal, and the control part does not shift from the first control to the second control when the determination part determines that the encoder is abnormal.

2. The printing device according to claim 1, wherein the encoder outputs a first pulse signal and a second pulse signal which have a predetermined phase difference; and wherein the counter counts the count value based on a rise and a fall of the first pulse signal and a rise and a fall of the second pulse signal.

3. The printing device according to claim 2, wherein in the first control, the determination part determines that the encoder is normal when a count value equal to or greater than 4 is counted, and determines that the encoder is abnormal when a count value less than 4 is counted.

4. The printing device according to claim 2, wherein in the first control, the control part drives the driving source by applying a constant voltage to the driving source for the first time regardless of the count value from the counter.

5. The printing device according to claim 4, wherein in the first control, the control part drives the driving source so as to cause the head part to move by 1 mm or less by applying the constant voltage to the driving source for the first time.

6. The printing device according to claim 2, wherein in the first control, the determination part detects whether or not there is an abnormality in the encoder over the first time in which the control part applies the voltage to the driving source, and a third time in which the control part does not apply the voltage to the driving source after an elapse of the first time.

7. The printing device according to claim 2, wherein in the first control, while the control part controls the driving source so as to cause the head part to move in a first direction, the determination part does not determine that the encoder is abnormal when the counter counts to a count value less than the predetermined number; and while the control part continues to controls the driving source so as to cause the head part to move in a second direction opposite to the first direction based on a determination result of the determination part, the determination part determines that the encoder is abnormal when the counter counts to a count value less than the predetermined number.

8. The printing device according to claim 1, wherein in the first control, the control part drives the driving source by applying a constant voltage to the driving source for the first time regardless of the count value from the counter.

9. The printing device according to claim 8, wherein in the first control, the control part drives the driving source so as to cause the head part to move by 1 mm or less by applying the constant voltage to the driving source for the first time.

10. The printing device according to claim 1, wherein in the first control, the determination part detects whether or not there is an abnormality in the encoder over the first time in which the control part applies the voltage to the driving source, and a third time in which the control part does not apply the voltage to the driving source after an elapse of the first time.

11. The printing device according to claim 1, wherein in the first control, while the control part controls the driving source so as to cause the head part to move in a first direction, the determination part does not determine that the encoder is abnormal when the counter counts to a count value less than the predetermined number; and while the control part continues to controls the driving source so as to cause the head part to move in a second direction opposite to the first direction based on a determination result of the determination part, the determination part determines that the encoder is abnormal when the counter counts to a count value less than the predetermined number.

* * * * *